US012612784B2

(12) United States Patent
Boo et al.

(10) Patent No.: US 12,612,784 B2
(45) Date of Patent: Apr. 28, 2026

(54) PRETENSIONED MECHANICAL LOCKING DEVICE FOR BUILDING PANELS

(71) Applicant: Välinge Innovation AB, Viken (SE)

(72) Inventors: Christian Boo, Kågeröd (SE); Per Nygren, Ramlösa (SE); Peter Derelöv, Viken (SE)

(73) Assignee: VÄLINGE INNOVATION AB, Viken (SE)

( * ) Notice: Subject to any disclaimer, the term of this patent is extended or adjusted under 35 U.S.C. 154(b) by 369 days.

(21) Appl. No.: 18/061,706

(22) Filed: Dec. 5, 2022

(65) Prior Publication Data

US 2023/0175260 A1 Jun. 8, 2023

(30) Foreign Application Priority Data

Dec. 6, 2021 (SE) ..... 2151481-5

(51) Int. Cl.
*E04C 2/40* (2006.01)
*E04F 13/08* (2006.01)
*E04F 15/02* (2006.01)

(52) U.S. Cl.
CPC ..... *E04C 2/40* (2013.01); *E04F 13/0894* (2013.01); *E04F 15/02038* (2013.01);
(Continued)

(58) Field of Classification Search
CPC .. E04C 2/40; E04F 13/0894; E04F 15/02038; E04F 15/102; E04F 15/105;
(Continued)

(56) References Cited

U.S. PATENT DOCUMENTS 7,441,384 B2 * 10/2008 Miller ..... E04F 15/04 52/591.1
7,874,118 B2 * 1/2011 Schitter ..... B44C 5/043 52/581
(Continued)

FOREIGN PATENT DOCUMENTS

EP 2995746 A2 3/2016
EP 3 848 531 A1 7/2021
(Continued)

OTHER PUBLICATIONS

U.S. Appl. No. 19/084,004, Roger Ylikangas, filed Mar. 19, 2025.
(Continued)

*Primary Examiner* — Brian E Glessner
*Assistant Examiner* — Adam G Barlow
(74) *Attorney, Agent, or Firm* — Boone IP Law

(57) ABSTRACT

A set of building panels, each building panel has a decorative surface and a mechanical locking device for horizontal and vertical locking of similar or essentially identical building panels in an assembled position. An upper edge portion of a side edge of a first building panel and an upper edge portion of a side edge of a second building panel are, in the assembled position, juxtaposed to form a joint seal. The mechanical locking device includes a locking surface at the upper edge portion of the side edge of the first building panel configured to cooperate with a locking surface at the upper edge portion of the side edge of the second building panel. The two locking surfaces are configured to lock the side edge of the first building panel and the side edge of the second building panel in a direction parallel to the extension of the decorative surface.

22 Claims, 14 Drawing Sheets

(52) U.S. Cl.
CPC ..... *E04F 2201/0146* (2013.01); *E04F 2201/0153* (2013.01); *E04F 2201/03* (2013.01); *E04F 2201/041* (2013.01); *E04F 2201/0547* (2013.01)

(58) Field of Classification Search
CPC ..... E04F 2201/0146; E04F 2201/0153; E04F 2201/03; E04F 2201/041; E04F 2201/0547; E04F 2201/0161; E04F 2201/0535; E04F 2201/0588
USPC ..... 52/582.1, 582.2, 586.1, 588.1, 578
See application file for complete search history.

(56) References Cited

U.S. PATENT DOCUMENTS

| | | | | |
|---|---|---|---|---|
| 8,353,140 | B2 * | 1/2013 | Pervan | H01F 7/0252 52/578 |
| 11,987,990 | B2 * | 5/2024 | Pervan | H01F 7/122 |
| 2009/0133353 | A1 * | 5/2009 | Pervan | H01F 7/122 52/747.1 |
| 2010/0293879 | A1 * | 11/2010 | Pervan | H04M 1/7246 52/588.1 |
| 2013/0047536 | A1 * | 2/2013 | Pervan | E04F 15/02038 52/309.1 |
| 2013/0263454 | A1 * | 10/2013 | Boo | E04C 2/38 29/897.32 |
| 2015/0000221 | A1 * | 1/2015 | Boo | E04C 2/40 52/588.1 |
| 2016/0201336 | A1 * | 7/2016 | Pervan | B26D 3/065 52/582.2 |
| 2017/0350139 | A1 | 12/2017 | De Rick | |
| 2020/0224430 | A1 * | 7/2020 | Ylikangas | E04C 2/40 |
| 2020/0284034 | A1 | 9/2020 | Pervan | |
| 2021/0355688 | A1 * | 11/2021 | Boo | B32B 13/14 |
| 2022/0090391 | A1 * | 3/2022 | Nilsson | B32B 9/045 |
| 2025/0122731 | A1 * | 4/2025 | Nilsson | E04F 15/102 |

FOREIGN PATENT DOCUMENTS

| | | | | |
|---|---|---|---|---|
| EP | 3 907 348 | A1 | 11/2021 | |
| WO | WO-2013191632 | A1 * | 12/2013 | B27M 3/04 |
| WO | 2021/058136 | A1 | 4/2021 | |
| WO | 2021/206611 | A1 | 10/2021 | |

OTHER PUBLICATIONS

U.S. Appl. No. 19/097,254, filed Apr. 1, 2025.
Notice and Search Report issued Jun. 20, 2022 by the Swedish Patent and Registration Office in corresponding Swedish Patent Application No. 2151481-5. (11 pages).
U.S. Appl. No. 16/738,602, Roger Ylikangas, filed Jan. 9, 2020.
U.S. Appl. No. 17/642,348, Roger Ylikangas, filed Mar. 11, 2022.
U.S. Appl. No. 17/505,229, Christian Boo, filed Oct. 19, 2021.
U.S. Appl. No. 17/709,930, Christian Boo, filed Mar. 31, 2022.
U.S. Appl. No. 18/146,602, Roger Ylikangas, filed Dec. 27, 2022.
U.S. Appl. No. 18/383,686, Roger Ylikangas, filed Oct. 25, 2023.
U.S. Appl. No. 18/966,070, Roger Ylikangas, filed Dec. 2, 2024.
U.S. Appl. No. 18/788,647, Christian Boo, filed Jul. 30, 2024.
U.S. Appl. No. 18/629,046, Christian Boo, filed Apr. 8, 2024.
Extended European Search Report issued by the European Patent Office on Oct. 23, 2025, in related European Application No. 22904773.3, 12 pages.

* cited by examiner

PRETENSIONED MECHANICAL LOCKING DEVICE FOR BUILDING PANELS

CROSS REFERENCE TO RELATED APPLICATIONS

The present application claims the benefit of Swedish Application No. 2151481-5, filed on Dec. 6, 2021. The entire contents of Swedish Application No. 2151481-5 are hereby incorporated herein by reference in their entirety.

TECHNICAL FIELD

The present application relates to the field of building panels, such as floor panels, wall panels, furniture components or similar.

TECHNICAL BACKGROUND

There are known building panels comprising a first mechanical locking device, typically along opposite long edges, for assembling of adjacent building panels in a locked position by means of a folding displacement. There are also known building panels comprising a second mechanical locking device, typically along opposite short edges, for assembling adjacent building panels in a locked position by means of a vertical displacement curtesy of a displaceable locking tongue.

Although such known building panels, in some aspects, may represent well-functioning building panels, there is still room for improvements in the technical field.

The main advantage of building panels with one or several mechanical locking systems are that they are easy to install. However, known systems suffer from drawbacks, for example in respect of the control of fluid penetration, such as sealing of the mechanical locking system. As such, there is room for improvements in the technical field.

The published document WO 2021/058136 discloses a possible solution of assembling a plurality of building panels. However, it is a desire from the market to increase the control of fluid penetration even more between and to make an even better tight seal between the building panels in order to prevent, e.g., fluid from penetrating into the building panels.

SUMMARY

An object of the present invention is to provide improvements over known art.

In a first aspect of the present invention there is provided a set of building panels, where each building panel includes a decorative surface layer and a mechanical locking device for horizontal and vertical locking of similar or essentially identical building panels in an assembled position by means of a folding and/or vertical displacement. An upper edge portion of a side edge of a first building panel and an upper edge portion of a side edge of a second building panel are, in the assembled position, juxtaposed to form a joint seal. The mechanical locking device having:

a locking surface at the upper edge portion of the side edge of the first building panel configured to cooperate with a locking surface at the upper edge portion of the side edge of the second building panel. The two locking surfaces are configured to lock the side edge of the first building panel and the side edge of the second building panel in a direction parallel to the extension of the decorative surface, a locking strip, projecting outwardly from a lower edge portion of the side edge of the first building panel. The locking strip includes a locking element configured to be received in a locking groove arranged in a lower edge portion of the side edge of the second building panel by means of the folding and/or vertical displacement, a locking surface on the locking element configured to cooperate with a locking surface in the locking groove, wherein the two surfaces are configured to prevent a displacement between the first and second building panel, an intermediate edge portion of the side edge of the second building panel comprising a surface configured to cooperate with a surface on the locking strip in the assembled position. The locking strip is configured to be angularly displaced during the folding and/or vertical displacement. The angular displacement together with the cooperation between the locking surface on the locking element and the locking surface in the locking groove are configured to create a pretension between the locking surface at the upper edge portion of the side edge of the first building panel and the locking surface at the upper edge portion of the side edge of the second building panel in the assembled position.

A difference between an angle, relative the extension of the decorative surface, of the surface on the locking strip and an angle, relative the extension of the decorative surface, of the surface on the intermediate edge portion of the side edge of the second building panel decreases during the folding and/or vertical displacement.

An advantage with the set of building panels as defined above is that a desirable pretension is created in the locking surfaces at the upper edge portion in the side edges of the two building panels in the assembled state, which in turn creates a tight seal between the locking surfaces. The tight seal between the locking surfaces minimizes the risk or even prevent fluid, such as water, to penetrate into the building panels which can cause the building panels to be damaged.

In an embodiment, the surface on the locking strip of the first building panel and the surface on the intermediate edge portion of the side edge of the second building panel may be planar.

In another embodiment, the surface on the locking strip of the first building panel and the surface on the intermediate edge portion of the side edge of the second building panel are substantially parallel in the assembled position.

In yet another embodiment, the surface on the locking strip of the first building panel and the surface on the intermediate edge portion of the side edge of the second building panel are substantially parallel to the extension of the decorative surface in the assembled position.

The mechanical locking device may further have a tongue groove, arranged in an intermediate edge portion of the side edge of the first building panel, configured to receive a locking tongue, protruding outwardly from an intermediate edge portion of the side edge of the second building panel.

The tongue groove and locking tongue as defined above may be advantageous to have along the longer sides of the building panels, if there are any, or along the sides of the building panels where an assembly between two building panels starts. These features are advantageous to have if two building panels are assembled by means of a folding displacement.

In an embodiment, the mechanical locking device further includes a locking surface at an upper wall of the tongue groove configured to cooperate with an upper locking surface of the locking tongue, where the two locking surfaces are configured to lock the side edge of the first building panel and the side edge of the second building panel in a direction perpendicular to the extension of the decorative surface in the assembled position.

The mechanical locking device may have a displaceable locking tongue, a displaceable tongue groove arranged in an intermediate edge portion of the side edge of the first building panel and configured to partly receive the displaceable locking tongue, and a displaceable tongue groove arranged in the intermediate edge portion of the side edge of the second building panel and configured to partly receive the displaceable locking tongue.

The tongue groove and the displaceable locking tongue as defined above may be advantageous to have along the shorter sides of the building panels, if there are any, or along the sides of the building panels where an assembly between two building panels ends. These features are advantageous to have if two building panels are assembled by means of a vertical displacement.

In an embodiment the mechanical locking device may further include a tongue groove, arranged in an intermediate edge portion of the side edge of the second building panel, configured to receive a locking tongue, protruding outwardly from an intermediate edge portion of the side edge of the first building panel.

The mechanical locking device may further have a locking surface at an upper wall of the tongue groove configured to cooperate with an upper locking surface of the locking tongue, where the two locking surfaces are configured to lock the side edge of the first building panel and the side edge of the second building panel in a direction perpendicular to the extension of the decorative surface in the assembled position.

In an embodiment, the height of the locking tongue of the intermediate edge portion of the side edge of the first building panel is greater than the height of the tongue groove in the intermediate edge portion of the side edge of the second building panel. This is advantageous since the locking between the locking tongue of the intermediate edge portion of the side edge of the first building panel and the tongue groove in the intermediate edge portion of the side edge of the second building panel create a complementary pretension to the pretension between the locking surfaces at the upper edge portion in the side edges of the two building panels in the assembled state. This complementary pretension minimizes the risk even further of fluid penetrating further down into the building panels.

The difference between the height of the locking tongue and the height of the tongue groove may be in the range of 0.01 to 0.5 mm, preferably 0.01 to 0.25 mm, more preferably 0.01 to 0.15 mm.

In yet another embodiment the pretension between the locking surface at the upper edge portion of a first side edge of a first building panel and the opposite locking surface at the upper edge portion of the third side edge of a second building panel, in the assembled position, is greater than the pretension between the locking surface at the upper edge portion of a second side edge of the first building panel and the opposite locking surface at the upper edge portion of the fourth side edge of a third building panel, in the assembled position.

In a second aspect of the inventive concept there is provided a set of building panels, where each building panel has a decorative surface and a mechanical locking device for horizontal and vertical locking of similar or essentially identical building panels in an assembled position by means of a folding and/or vertical displacement. An upper edge portion of a side edge of a first building panel and an upper edge portion of a side edge of a second building panel are, in the assembled position, juxtaposed to form a joint seal.

The mechanical locking device includes:

- a locking strip, projecting outwardly from a lower edge portion of the side edge of the first building panel, having a locking element configured to be received in a locking groove arranged in a lower edge portion of the side edge of the second building panel by means of the folding and/or vertical displacement,
- a locking surface at the upper edge portion of the side edge of the first building panel configured to cooperate with a locking surface at the upper edge portion of the side edge of the second building panel, where the two locking surfaces are configured to lock the side edge of the first building panel and the side edge of the second building panel in a direction parallel to the extension of the decorative surface,
- a locking surface on the locking element configured to cooperate with a locking surface in the locking groove, where the two surfaces are configured to prevent a displacement between the first and second panel.

A first dimension, measured between a point on the locking surface at the upper edge portion of the side edge of the first building panel and a point on the locking surface on the locking element, in an unassembled position, is smaller than a second dimension, measured between the point on the locking surface at the upper edge portion of the side edge of the first building panel and the point on the locking surface of the locking element, in the assembled position.

An advantage with the set of building panels as defined above is that a desirable pretension is created in the locking surfaces at the upper edge portion in the side edges of the two building panels in the assembled state, which in turn creates a tight seal between the locking surfaces. The tight seal between the locking surfaces minimizes the risk or even prevent fluid, such as water, to penetrate into the building panels which can cause the building panels to be damaged.

In an embodiment, a third dimension, measured between a point on the locking surface at the upper edge portion of the side edge of the second building panel and a point on the locking surface in the locking groove, is greater than the first dimension.

The mechanical locking device may further include a tongue groove, arranged in an intermediate edge portion of the side edge of the first building panel, configured to receive a locking tongue, protruding outwardly from an intermediate edge portion of the side edge of the second building panel.

The tongue groove and locking tongue as defined above may be advantageous to have along the longer sides of the building panels, if there are any, or along the sides of the building panels where an assembly between two building panels starts. These features are advantageous to have if two building panels are assembled by means of a folding displacement.

In an embodiment, the mechanical locking device further includes a locking surface at an upper wall of the tongue groove configured to cooperate with an upper locking surface of the locking tongue, wherein the two locking surfaces are configured to lock the side edge of the first building panel and the side edge of the second building panel in a direction perpendicular to the extension of the decorative surface in the assembled position.

In an alternative embodiment, the mechanical locking device may further include a displaceable locking tongue, a displaceable tongue groove arranged in an intermediate edge portion of the side edge of the first building panel and configured to partly receive the displaceable locking tongue, and a displaceable tongue groove arranged in the intermediate edge portion of the side edge of the second building panel and configured to partly receive the displaceable locking tongue.

The tongue groove and the displaceable locking tongue as defined above may be advantageous to have along the shorter sides of the building panels, if there are any, or along the sides of the building panels where an assembly between two building panels ends. These features are advantageous to have if two building panels are assembled by means of a vertical displacement.

In an embodiment the mechanical locking device further has a tongue groove, arranged in an intermediate edge portion of the side edge of the second building panel, configured to receive a locking tongue, protruding outwardly from an intermediate edge portion of the side edge of the first building panel.

The mechanical locking device may further include a locking surface at an upper wall of the tongue groove configured to cooperate with an upper locking surface of the locking tongue, wherein the two locking surfaces are configured to lock the side edge of the first building panel and the side edge of the second building panel in a direction perpendicular to the extension of the decorative surface in the assembled position.

In an embodiment the height of the locking tongue of the intermediate edge portion of the side edge of the first building panel is greater than the height of the tongue groove in the intermediate edge portion of the side edge of the second panel. This is advantageous since the locking between the locking tongue of the intermediate edge portion of the side edge of the first building panel and the tongue groove in the intermediate edge portion of the side edge of the second building panel create a complementary pretension to the pretension between the locking surfaces at the upper edge portion in the side edges of the two building panels in the assembled state. This complementary pretension minimizes the risk even further of fluid penetrating further down into the building panels.

The difference between the height of the locking tongue and the height of the tongue groove may be in the range of 0.01 to 0.5 mm, preferably 0.01 to 0.25 mm, more preferably 0.01 to 0.15 mm.

In an embodiment a pretension between the locking surface at the upper edge portion of a first side edge of a first building panel and the opposite locking surface at the upper edge portion of the third side edge of a second building panel, in the assembled position, is greater than the pretension between the locking surface (at the upper edge portion of a second side edge of the first building panel and the opposite locking surface at the upper edge portion of the fourth side edge of a third building panel, in the assembled position.

BRIEF DESCRIPTION OF THE DRAWINGS

Embodiments of the invention will be described in the following: reference being made to the appended drawings which illustrate non-limiting embodiments of how the inventive concept can be reduced into practice.

DETAILED DESCRIPTION OF EMBODIMENTS

Figure 1:
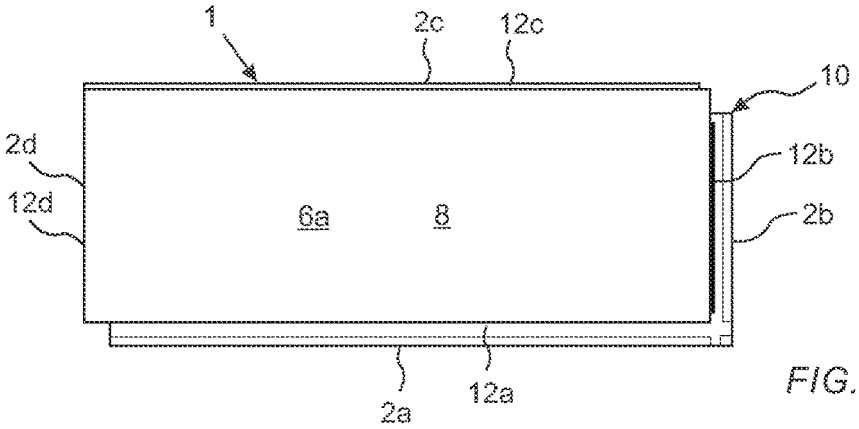
FIG. 1 schematically illustrates a building panel according to an embodiment of the inventive concept.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements. Generally, in this disclosure, terms like "below" or "lower" typically implies closer to the back surface of the panel or a plane thereof, whereas "above" or "upper" implies closer to the front surface or a plane thereof. Further, the thickness direction of the panel is defined as the vertical direction when the panel lays flat on a surface. The horizontal and vertical direction are applicable definition when the building panel is lays flat on, e.g., a floor. Instead of horizontal and vertical directions, the description will also refer to a direction parallel with extension of the decorative surface and a direction perpendicular to the extension of the decorative surface. When a building panel is lays flat on, e.g., a floor, the horizontal direction is the same as the direction parallel with the extension of the decorative surface and the vertical direction is the same as the direction perpendicular to the extension of the decorative surface.

With reference to the drawings, there is illustrated a building panel 1 in FIG. 1. The building panel 1 may for example be a floor panel, a wall panel, a ceiling panel, a furniture element or similar.

The building panel 1 includes four side edges 2*a*-2*d*. The building panel 1, as illustrated, further includes a substrate 7 and a surface layer 8 arranged on one side of the substrate 7. The surface layer 8 may preferably be a decorative surface layer. The surface layer 8 is configured to face a user in an installed position.

The surface layer 8 is an optional layer 8. If no surface layer 8 is present it is possible, if desirable, to provide the substrate 7 with a decorative feature, e.g. a print or the like.

The substrate 7 may be a wood-based substrate, e.g. made of a HDF board, a particle board, or a plywood material. Alternatively, the substrate may be a polymer-based core, such as comprising a thermoplastic material, and preferably a filler, or a thermosetting material. For example, the thermoplastic material may comprise PVC and the thermosetting material may comprise a melamine formaldehyde resin. In yet another alternative, the substrate may be a mineral-based core, such as comprising magnesium oxide and, optionally, magnesium chloride, e.g., $MgCl_2$, and/or magnesium sulfate, e.g., $MgSO_4$.

The building panel 1 may have a second surface layer 9 arranged on the substrate 7, on the opposite side of the optional decorative surface layer 8. The second surface layer 9 may be a balancing layer.

The building panel 1 has a frontside 6*a* and a backside 6*b*. The frontside 6*a* preferably includes the decorative surface layer 8. The backside 6*b* is where the optional second surface layer 9 is arranged.

The building panel 1 includes a mechanical locking device 10 for horizontal and vertical locking of similar or essentially identical building panels in an assembled position by means of a folding and/or vertical displacement.

The mechanical locking device 10 is arranged along the side edges 2*a*-2*d* of the building panel 1. The mechanical locking device 10 includes connecting means 12*a*-12*d*. Each side edge 2*a*-2*d* may be provided with different connecting means 12*a*-12*d* where the connecting means 12*a*-12*d* of opposite side edges 2*a*-2*d* are compatible with each other. The mechanical locking 10 device may be provided with a first pair of connecting means 12*a*, 12*c* and second pair of connecting means 12*b*, 12*d*. For example, the connecting means 12*a* of the first pair is arranged along one long side edge 2*a* of the building panel 1 is compatible with the connecting means 12*c* arranged along the opposite long side edge 2*c* of the building panel 1, and the connecting means 12*b* of the second pair is arranged along one short side edge 2*b* of the building panel 1 is compatible with the connecting means 12*d* arrange along the opposite short side edge 2*d* of the building panel 1.

In another embodiment (not shown) the first pair of connecting means is arranged at opposite short side edges of the building panel, and the second pair of connecting means is arranged at opposite long side edges of the building panel.

In yet another embodiment (not shown) the first pair of connecting means and the second pair of connecting means of the mechanical locking device may be the same. For example, a long side edge may connect to an opposite long side edge or to a short side edge.

Figure 2A:
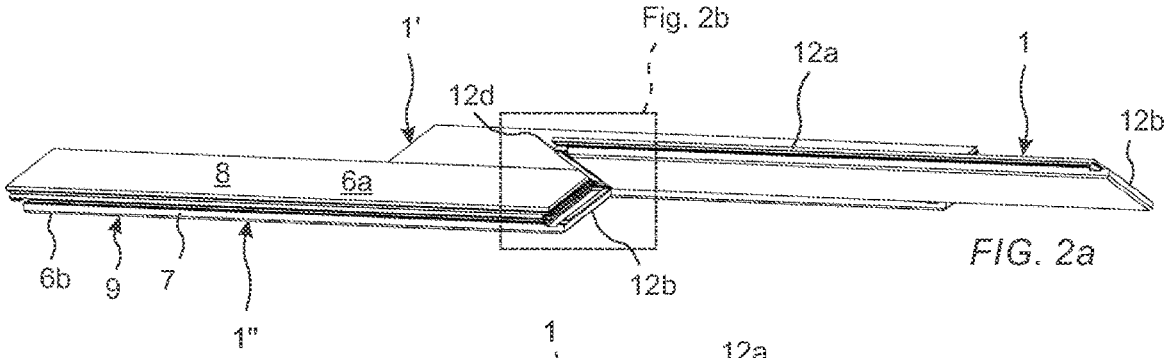
FIG. 2*a* illustrates an assembly of a plurality of building panels.
Figure 2B:
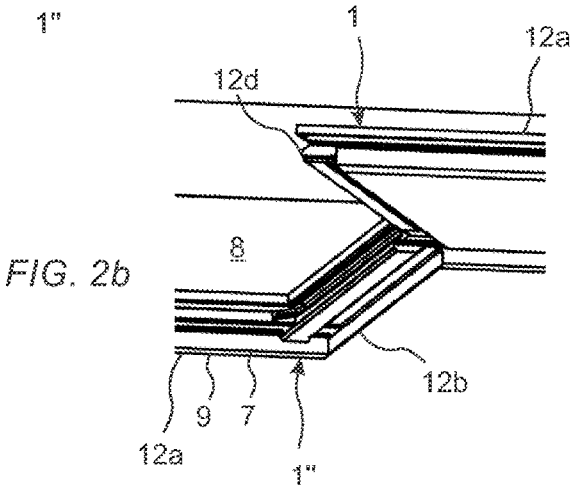
FIG. 2*b* is a detailed view of the assembly in FIG. 2*a*, FIG. 2*c* illustrate the finished assembly of FIG. 2*a*.

The installation of two adjacent building panels 1 is illustrated in FIG. 2*a* and a detailed illustration of the folding displacement is illustrated in FIG. 2*b*.

A first building panel 1 is assembled to a second building panel 1' by means of the first pair of connecting means 12*a*, 12*c* provided along respective long side edges 2*a*, 2*c* of respective building panels 1, 1'. The first pair of connecting means 12*a*, 12*c* is configured to assemble and lock adjacent building panels 1, 1' in a horizontal and vertical direction by means of the folding displacement When the first building panel 1 is assembled with the second building panel 1' the first building panel 1 may preferably be displaceable in the horizontal direction such that the first building panel 1 is placed in the right location for being assembled to the third building panel 1"

The first building panel 1 is then assembled to a third building panel 1" by means of the second pair of connecting means 12*b*, 12*d* provided along respective short side edge 2*b*, 2*d* of respective building panel 1, 1". The second pair of connecting means 12*b*, 12*d* is configured to assemble and lock adjacent building panels 1, 1" in a horizontal and vertical direction by means of a vertical displacement, such as vertical folding.

In an alternative installation (not shown) the first building panel may firstly be assembled with the third building panel, along the short side edge, and then assembled to the second building panel, along the long side edge.

Figure 2C:
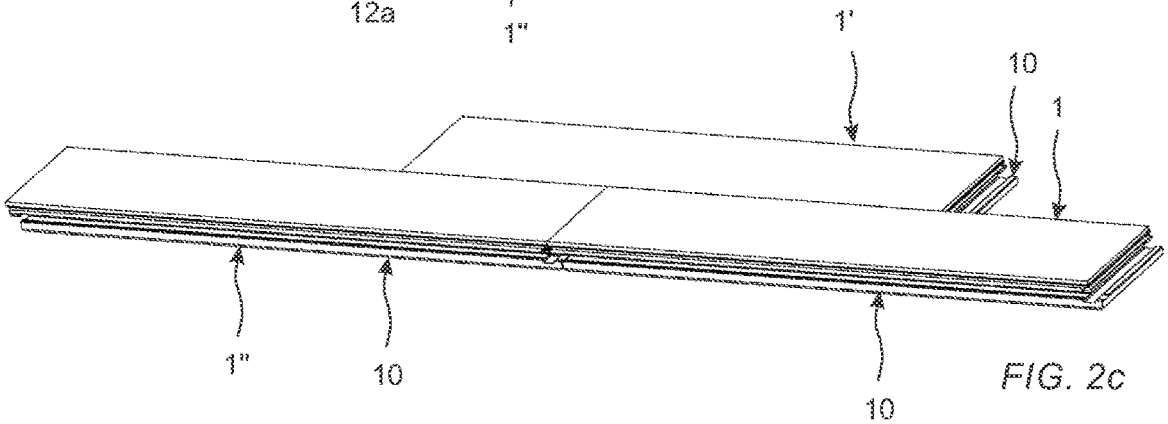

In the assembled position, as is illustrated in FIG. 2*c*, an upper edge portion of the side edge 2*c* of the first building panel 1 and an upper edge portion of the side edge 2*a* of the second panel 1' are juxtaposed to form a joint seal JS between the first and second building panel 1, 1'. Further, in the assembled position, an upper edge portion of the side edge 2*d* of the first building panel 1 and an upper edge portion of the side edge 2*b* of the third building panel 1" are juxtaposed to form a joint seal JS between the first and third building panel 1, 1".

The detailed description of embodiments below is based on the assembling illustrated in FIG. 2*c*, i.e., with a first, a second and a third building panel 1, 1', 1". Since all building panels 1, 1', 1" are similar or essentially identical, all features of the mechanical locking device are present on each building panel 1, 1', 1".

Figure 3A:
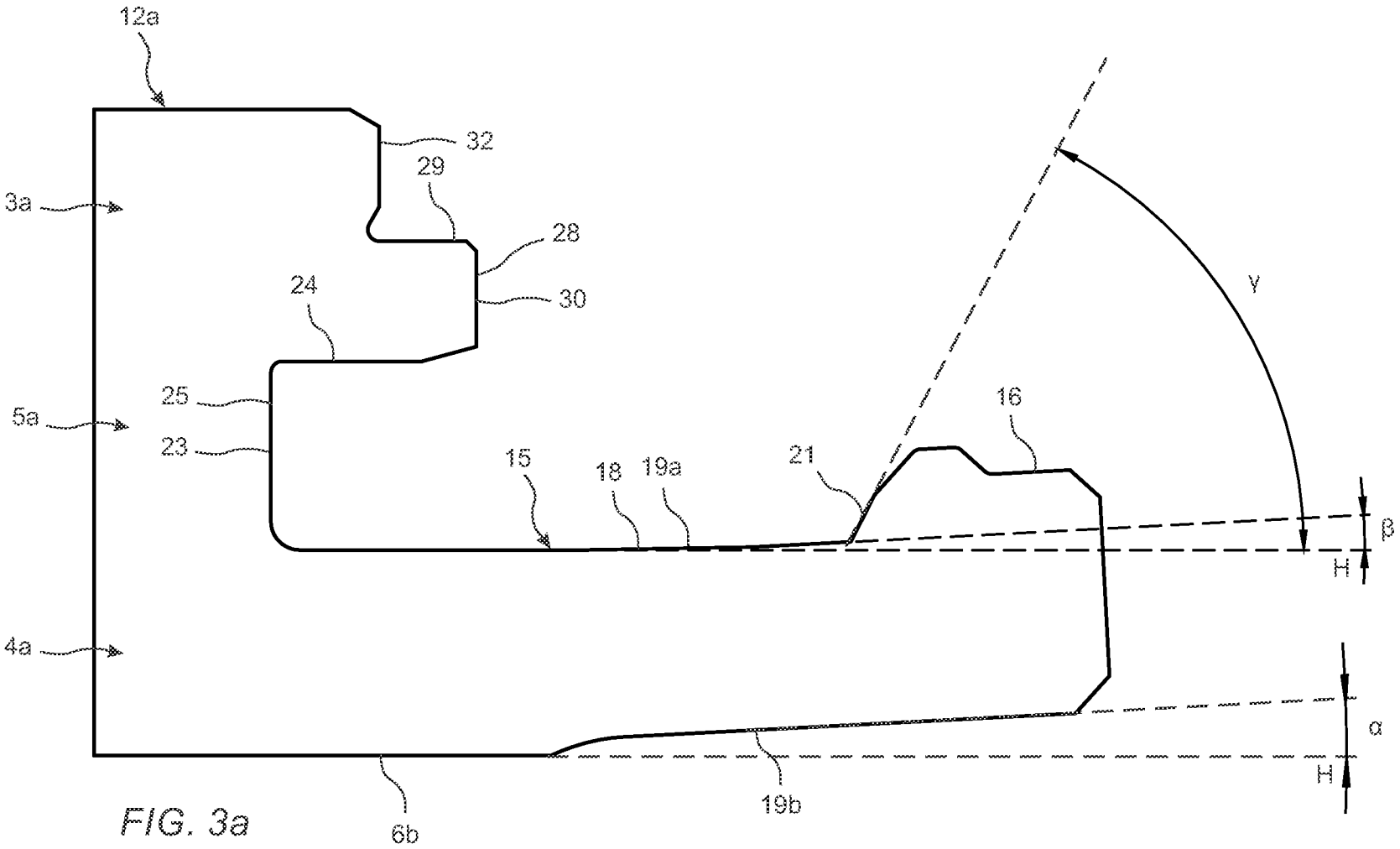
FIGS. 3*a*-3*c* illustrates a cross section of a first connecting means of a mechanical locking device according to an embodiment of the inventive concept and a detailed view of the connecting means.
Figure 3B:
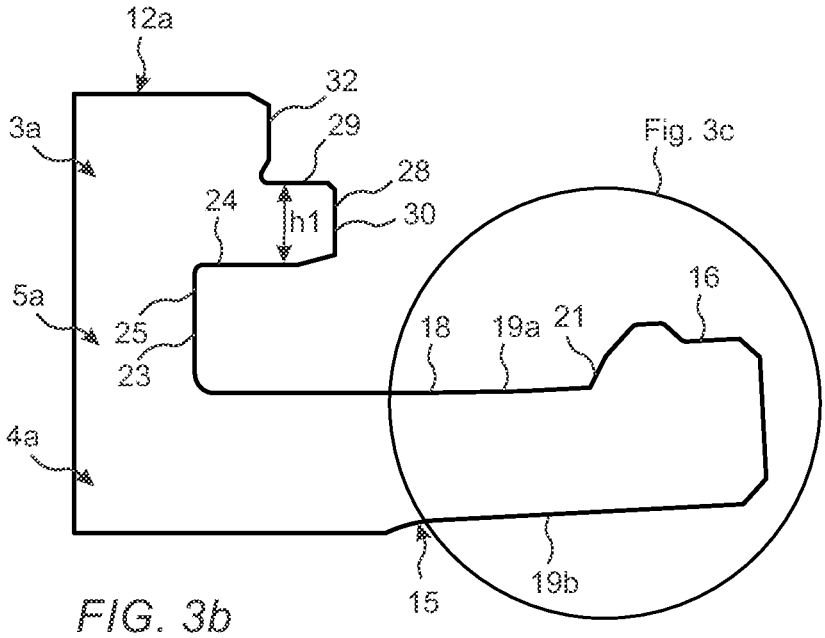
Figure 3C:
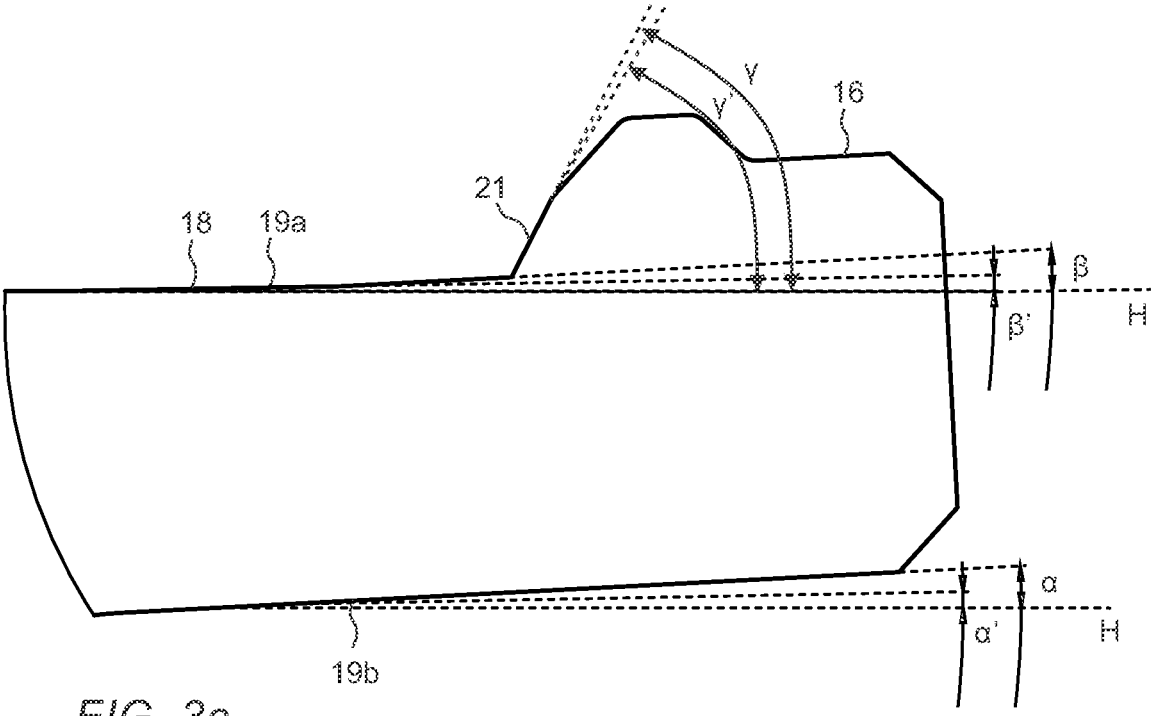

FIGS. 3*a*-3*c* illustrate a first connecting means 12*a* of a first pair of connecting means 12*a*, 12*c* of the mechanical locking device 10, in an unassembled position. The first connecting means 12*a* is compatible with a second connecting means 12*c* of the first pair of connecting means 12*a*,12*c*. The first pair of connecting means 12*a*, 12*c* are configured to vertically and horizontally lock two adjacent building panels 1, 1'.

Figure 4:
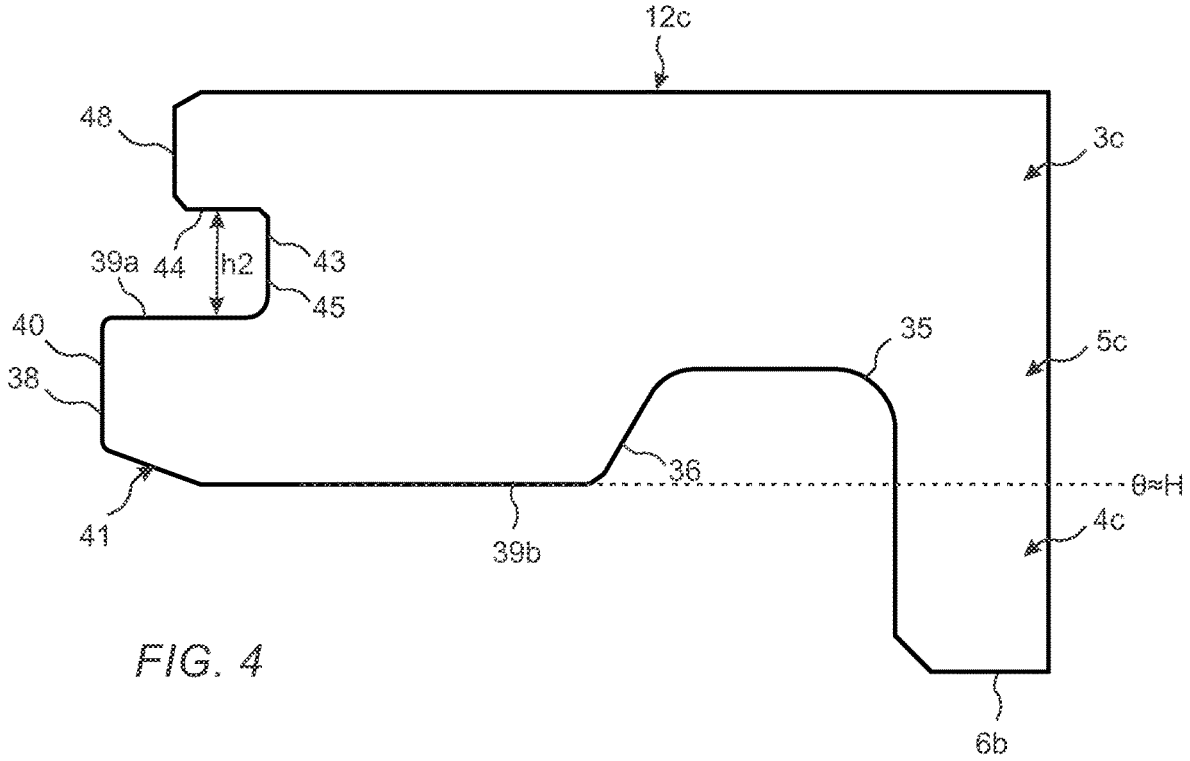
FIG. 4 illustrates a cross section of a second connecting means of the mechanical locking device.

The first connecting means 12*a* is preferably integrally formed at the side edge 2*a* of the building panel. The second connecting means 12*c*, illustrated in FIG. 4, is preferably integrally formed at the opposite side edge 2*c* of the building panel.

The first connecting means 12*a* includes a locking strip 15, preferably integrally formed in the side edge 2*a* of the building panel. The locking strip 15 is arranged at a lower edge portion 4*a* of the side edge 2*a* of the building panel, projecting outwards from the lower edge portion 4*a*. The locking strip 15 is configured to be angularly displaced during the folding displacement, as explained in more detail below.

The locking strip 15 includes, at the outmost end of the locking strip 15, a locking element 16. The locking element 16 is configured to be received in a locking groove 35 arranged in an intermediate edge portion 5*c* and/or lower edge portion 4*c* of the side edge 2*c* of an adjacent building panel, by means of the folding displacement.

The locking strip 15 has an elongated shape with the locking element 16 arranged at the outermost end. Between the innermost end of the locking strip 15 and the locking element 16 the locking strip 15 has an elongated body 18. The elongated body 18 has an upper surface 19*a* facing the frontside 6*a* of the building panel and a lower surface 19*b* facing the backside 6*b* of the building panel. The upper surface 19*a* is plane.

The elongated body 18 is configured to be bendable, to the extent that a portion of the elongated body 18 during installation of two building panels 1, 1', 1" may be pushed and displaced downwards by the second connecting means 12*c*.

The upper and lower surface 19*a*, 19*b* extend, around the innermost end of the elongated body 18, in a substantially horizontal direction. At a point along, as illustrated, moving towards the outermost end, the upper and lower surface 19*a*, 19*b* of the elongated body 18 are shaped at an angle upwards. Optionally, at a point along, moving towards the outermost end, at least the lower surface 19*b* of the elongated body 18 is shaped at an angle upwards.

Figure 5A:
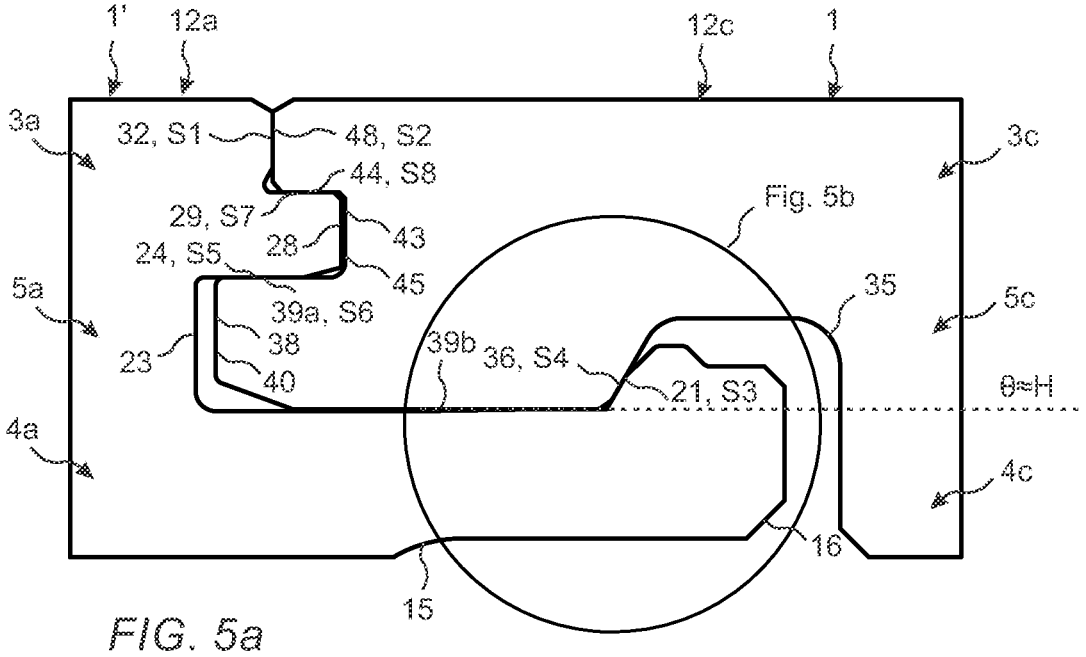
FIG. 5*a* illustrates a cross section of the mechanical locking device with the first and second connecting means as illustrated in FIGS. 3*a*-*c* and 4, in an assembled position.
Figure 5B:
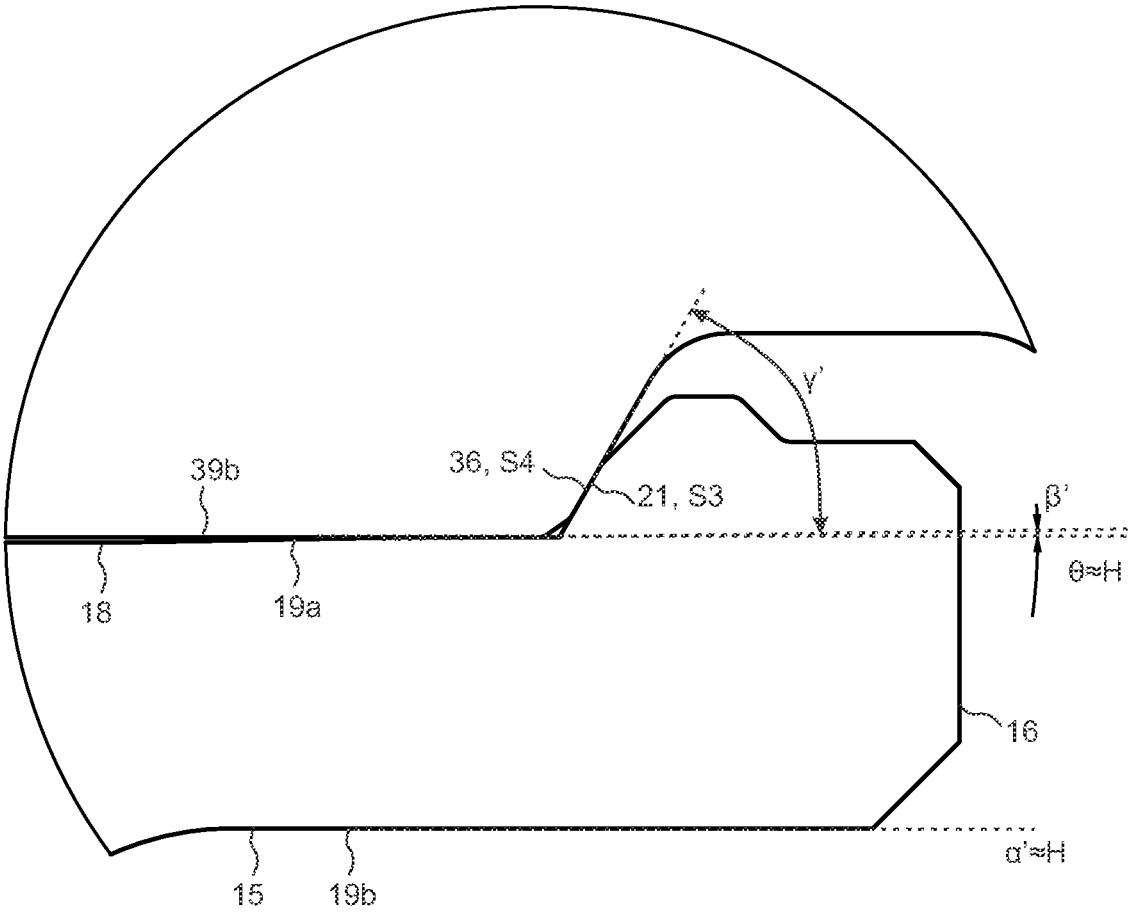
FIG. 5*b* is a detailed view of the cross section in FIG. 5*a*.
Figure 6:
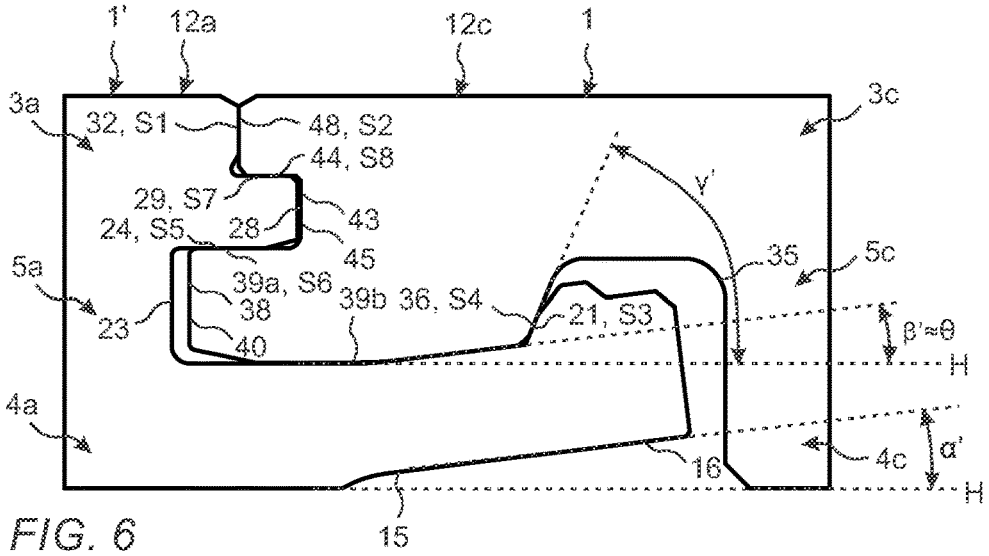
FIG. 6 illustrates a cross section of a mechanical locking device according to another embodiment of the inventive concept, in an assembled position.

At the innermost end of the locking strip 15 the lower surface 19*b* of the elongated body 18 may be flush with the backside 6*b* of the building panel. The backside 6*b* of the building panel is parallel with a horizontal axis H. Moving out towards the outermost end and the locking element 16 of the locking strip 15 the lower surface 19*b* of the elongated body 18 is shaped to form a first angle α to the horizontal axis H. The lower surface 19*b* of the elongated body 18 is slightly shaped at an angle upwards. The first angle α is in the unassembled position within a range about 0.5° to 5°, within a range about 1° to 4° or within a range about 2° to 3°. During the installation, as illustrated in FIGS. 5*a* and 5*b*, the first angle α will decrease due to the bendability of the elongated body 18. The first angle α', in the assembled position is within a range about −2° to 2°, within a range about −1° to 1° or about 0°. The difference between the first angle α in the unassembled position and the first angle α' in the assembled position is within a range about 0.5° to 5°, within a range about 1° to 4° or within a range about 2° to 3°.

The upper surface 19*a* of the elongated body 18 of the locking strip 15 is shaped to form a second angle β to the horizontal axis H. The upper surface 19*a* of the elongated body 18 is slightly shaped at an angle upwards. The second angle β is in the unassembled position within a range about 0.5° to 5°, within a range about 1° to 4° or within a range about 2° to 3°. The elongated body 18 of the locking strip 15 is configured to be angularly displaced during the installation. During the installation, as illustrated in FIGS. 5*a* and 5*b*, the second angle β will decrease due to the bendability of the elongated body 18 and due to a lower surface 39*b* of the second connecting means 12*c* pushing on the upper surface 19*a*. The second angle β', in the assembled position is within a range about −2° to 2°, within a range about −1° to 1° or about 0°. The difference between the first angle β in the unassembled position and the first angle β' in the assembled position is within a range about 0.5° to 5°, within a range about 1° to 4° or within a range about 2° to 3°.

The lower surface 39*b* of the second connecting means 12*c* may be formed at an angle θ. The angle θ is in the unassembled position within a range about −5° to 5°, within a range about −3° to 3° or within a range about −1° to 1°, in relation to a horizontal axis H. In the illustrated embodiment in FIGS. 4, 5*a* and 5*b* the angle θ is essentially parallel to the horizontal axis H. The difference between the angle β of the upper surface 19*a* and an angle θ of the lower surface 39*b* decreases during the folding displacement.

The upper surface 19*a*, in the assembled position, extends preferably in the same direction as the lower surface 39*b* of the second connecting means 12*c* pushing on the upper surface 19*a*. The upper surface 19*a* and the lower surface 39*b* are plane. Alternatively, the upper surface 19*a*, in the assembled position, at least partly extends preferably in the same direction as the lower surface 39*b* of the second connecting means 12*c* pushing on the upper surface 19*a*. The upper surface 19*a* of the elongated body 18 of the first connecting means 12*a*, in the assembled position, is configured to cooperate and preferably at least partly be in contact with the lower surface 39*b* of the second connecting means 12*c*.

FIG. 3*c* illustrate a detailed view of the upper surface 19*a* of the elongated body 18 and the second angle β in the unassembled position and the second angle β' in the desirable assembled position.

The locking element 16 of the locking strip 15 includes a front locking surface 21. The front locking surface 21 is arranged at the innermost end of the locking element 16. The upper surface 19*a* of the elongated body 18 merges into the front locking surface 21 of the locking element 16.

The front locking surface 21 of the locking element 16 is shaped to form a third angle γ to the horizontal axis H. The front locking surface 21 is shaped at an angle upwards, in a direction towards the decorative surface layer 8. The third angle γ is in the unassembled position within the range about 45° to 90°. During the installation the third angle γ will decrease due to the bendability of the elongated body 18. The difference between the third angle γ in the unassembled position and the third angle γ' in the assembled position is within a range about 1° to 5° or within a range about 2° to 3°.

The front locking surface 21 of the locking element 16, in the assembled position, extends preferably in the same direction as a front wall 36 of the locking groove 35 of the second connecting means 12*c*. Alternatively, the front locking surface 21 of the locking element 16, in the assembled position, at least partly extends preferably in the same direction as the front wall 36 of the locking groove 35 of the second connecting means 12*c*. The front locking surface 21 of the locking element 16 of the first connecting means 12*a*, in the assembled position, is configured to cooperate and preferably at least partly be in contact with the front wall 36 of the locking groove 35 of the second connecting means 12*c*.

The first connecting means 12*a* further includes a tongue groove 23. The tongue groove 23 is arranged in the intermediate edge portion 5*a* of the side edge 2*a* of the building panel and extends inwards into the side edge 2*a*. The tongue groove 23 is arranged above the locking strip 15, at the innermost end of the locking strip 15.

The tongue groove 23 is configured and shaped to receive a locking tongue 38 of the second connecting means 12*c* of the adjacent building panel. In the assembled position, the tongue groove 23 is configured to vertically and preferably horizontally lock the locking tongue 38 and the building panel.

An upper wall 24 of the tongue groove 23 is configured to cooperate and preferably be in contact with an upper surface 39*a* of the locking tongue 38 of the second connecting means 12*c*. The upper wall 24 is configured to vertically lock the locking tongue 38.

The first connecting means 12*a* further includes an upper tongue 28. The upper tongue 28 is arranged in the intermediate and/or upper edge portion 5*a*, 3*a* of the side edge 2*a* of the first building panel and extends outwards away from the side edge 2*a*. The upper tongue 28 is arranged above the tongue groove 23.

The upper tongue 28 is configured and shaped to be received in an upper tongue groove 43 of the second connecting means 12*c* of the adjacent building panel. In the assembled position, the upper tongue 28 is configured to be vertically and preferably horizontally locked in the upper tongue groove 43.

It is preferred to have a height h1 of the upper tongue 28 of between 0.5 and 2.5 mm. It is preferred for the height h1 of the upper tongue 28 to be greater than the height h2 of the upper tongue groove 43. The difference between the height h1 of the upper tongue 28 and the height h2 of the upper tongue groove 43 is in the range of 0.01 to 0.5 mm, preferably 0.01 to 0.25, more preferably 0.01 to 0.15 mm.

As the upper tongue 28 is arranged in the upper tongue groove 43, in the assembled position, the upper tongue 28 and the upper tongue groove 43 creates a tight seal. This is advantageous since the tight seal obstruct e.g. water or other fluids, to penetrate further down into the mechanical locking device 10.

An upper surface 29 of the upper tongue 28 is configured to cooperate and preferably be in contact with an upper wall 44 of the upper tongue groove 43 of the second connecting means 12*c*. The upper wall 44 of the upper tongue groove 43 is configured to vertically lock the upper tongue 28.

At the upper edge portion 3*a* of the side edge 2*a* of the building panel there is provided an essentially vertical locking surface 32. At the upper edge portion 3*c* of the opposite side edge 2*c* of the building panel there is provided an opposite essentially vertical locking surface 48. The locking surface 32 of the second building panel 1' is configured to cooperate, and preferably be in contact with the locking surface 48 of the first building panel 1, in the assembled position, as illustrated in FIG. 5*a*. Together, the locking surface 32 of the second building panel 1' and the locking surface 48 of the first building panel 1 form a first locking pair S1, S2 as explained in more detail below.

Although many of the features of the second connecting means 12*c* has been described above, additional features are now described in more detail.

FIG. 5*a* illustrate the first and second connecting means 12*a*, 12*c* in the assembled position. FIG. 5*b* is a detailed view of the cooperation between the first and second connecting means 12*a*, 12*c* in the assembled position.

The second connecting means 12*c*, which alone is illustrated in FIG. 4, includes the locking groove 35. The locking groove 35 is arranged in the lower edge portion 4*c* of the side edge 2*c* of the building panel and extends upwards into and away from the backside 6*b* of the building panel.

The locking groove 35 is configured and shaped to receive the locking element 16 of the locking strip 15 of the first connecting means 12*a*. In the assembled position, the locking groove 35 is configured to vertically and preferably horizontally lock the locking element 16. In order to do so the locking groove 35, in the illustrated embodiments, includes a front wall 36. The front wall 36 is configured to, in the assembled position, cooperate and preferably at least partly be in contact with the front locking surface 21 of the locking element 16 of the first connecting means 12*a* of the adjacent building panel. Together, the front wall 36 of the locking groove 35 of the second connecting means 12*c* and the front locking surface 21 of the locking element 16 of the first connecting means 12*a* form the second locking pair S3, S4 as explained in more detail below.

The front wall 36 of the locking groove 35 is a sloped wall which is configured to engage the front locking surface 21 of the locking element 16 during the installation. In the assembled position the angle γ' of the front locking surface 21 is essentially the same as the angle of the sloped front wall 36, in relation to a horizontal axis H.

Further, the second connecting means 12*c* includes a locking tongue 38. The locking tongue 38 is arranged in the intermediate edge portion 5*c* of the side edge 2*c* of the building panel and extends outwards, away from the side edge 2*c*.

The locking tongue 38 is at least partly configured and shaped to be received in the tongue groove 23 of the first connecting means 12*a* of the adjacent building panel. In the assembled position, the locking tongue 38 is configured to be vertically and preferably horizontally locked in the tongue groove 23.

The locking tongue 38 has an elongated shape where an outermost portion 41 is received in the tongue groove 23 in the assembled position. The outermost portion 41 has an upper surface 39*a* which is configured to cooperate and preferably be in contact with the upper wall 24 of the tongue groove 23 of the adjacent building panel. The upper wall 24 is configured to vertically lock the locking tongue 38. Together, the upper wall 24 of the tongue groove 23 of the first connecting means 12*a* and the upper surface 39*a* of the locking tongue 38 of the second connecting means 12*c* form the third locking pair S5, S6 as explained in more detail below.

In the intermediate edge portion 5*a* there is further a lower surface 39*b*. The lower surface 39*b* may merge into the locking tongue 38. The lower surface 39*b* may have different parts shaped at different angles, e.g. a middle part may be substantially horizontal and an innermost part may be shaped at an angle θ upwards, towards the decorative surface layer 8. The innermost part of the lower surface 39*b* is configured to cooperate and preferably be in contact with the angled upper surface 19*a* of the elongated body 18 of the locking strip 15 of the first connecting means 12*a* of the adjacent building panel. During installation the lower surface 39*b* is configured to displace, and preferably push on, the upper surface 19*a* of the elongated body 18 of the locking strip 15. In the assembled position the angle β' of the upper surface 19*a* is essentially the same as the angle θ of the lower surface 39*b* of the locking tongue 38, which preferably is an angle parallel with the horizontal plane H. Thus, the upper surface 19*a* and the lower surface 39*b* are substantially parallel in the assembled position. In other words, the difference between the angle β of the upper surface 19*a* in the unassembled position, and the angle θ of the lower surface 39*b* decreases during the assembling of the adjacent building panel 1, 1', as illustrated in FIGS. 5*a* and 5*b*.

Further, the upper surface 19*a* of the elongated body 18, in the assembled position, extends in the same direction as the lower surface 39*b* of the locking tongue 38, which preferably is the horizontal direction H. Alternatively, the upper surface 19*a*, in the assembled position, at least partly extends in the same direction as the lower surface 39*b*.

The second connecting means 12*c* also includes an upper tongue groove 43. The upper tongue groove 43 is arranged in the intermediate and/or upper edge portion 5*c*, 3*c* of the side edge 2*c* of the building panel, and extends inwards, into the building panel. The upper tongue groove 43 is arranged above the locking tongue 38.

The upper tongue groove 43 is configured and shaped to receive the upper tongue 28 of the first connecting means 12*a* of the adjacent building panel. In the assembled position, the upper tongue groove 43 is configured to vertically lock the upper tongue 28.

As explained above, it is preferred to have a height h1 of the upper tongue 28 of between 0.5 and 2.5 mm. It is preferred for the height h1 of the upper tongue 28 to be greater than the height h2 of the upper tongue groove 43. Thus, as the upper tongue 28 is arranged in the upper tongue groove 43, in the assembled position, the upper tongue 28 and the upper tongue groove 43 creates a tight seal. This is advantageous since the tight seal obstruct e.g., water or other fluids, to penetrate further down into the mechanical locking device 10.

An upper wall 44 of the upper tongue groove 43 is configured to cooperate and preferably be in contact with an upper surface 29 of the upper tongue 28 of the first connecting means 12*a* of the adjacent building panel. The upper wall 44 is configured to vertically lock the upper tongue 28. Together, the upper wall 44 of the upper tongue groove 43 of the second connecting means 12*c* and the upper surface 29 of the upper tongue 28 of the first connecting means 12*a* form the fourth locking pair S7, S8 as explained in more detail below.

In the assembled position a plurality of locking pairs S1, S2, S3, S4, S5, S6, S7, S8 are created. In the assembled position at least four locking pairs S1, S2, S3, S4, S5, S6, S7, S8 are created.

The first locking pair S1, S2 is located in the upper edge portions 3*a*, 3*c* of the first and second building panels 1, 1', includes two opposite locking surfaces S1, S2. The first locking pair S1, S2 is configured to create a locking in the horizontal direction. The horizontal direction may also be referred to at a direction parallel to the extension of the decorative surface layer 8. Thus, the first locking surface S1, at the upper edge portion 3*a* of the side edge 2*a* of the second building panel 1' is configured to cooperate with the second locking surface S2 at the upper edge portion 3*c* of the side edge 2*c* of the first building panel 1, where the two locking surfaces S1, S2 are configured to lock the side edge 2*c* of the first building panel 1 and the side edge 2*a* of the second building panel 1' in a direction parallel to the extension of the decorative surface layer 8.

The first locking pair S1, S2 further creates a pretension in order to create a tight seal between the upper edge portions 3*a*, 3*c* of the two juxtaposed building panels 1, 1'. The tight seal is advantageous since it obstructs or even prevents e.g., water or other fluids, to penetrate down into the mechanical locking device 10 and the building panels 1, 1', 1".

A pretension is created as soon as two building panels 1, 1', 1" are assembled together and the two locking surfaces S1, S2 starts cooperating, or preferably are in contact with each other. However, the pretension created by the mechanical locking device 10, as illustrated and described in this application, is increased to a desirable level mostly due to the bendable elongated body 18 of the locking strip 15. As the elongated body 18 of the locking strip 15 of the first connecting means 12*a*, during installation, is displaced, and pushed down, by the lower surface 39*a* of the locking tongue 38 of the second connecting means 12*c* the first locking surface S1 is pushed towards the second locking surface S2 which in turn is locked in the horizontal direction by means of at least the locking element 16 of the locking strip of the first connecting means 12*a* arranged in the locking groove 35 of the second connecting means 12*c*. Thus, the pretension between the two locking surfaces S1, S2 of the first locking pair is increased.

The pretension between the two locking surfaces S1, S2 may, in an environment with normal humidity of two building panels each being 100 mm long, is between 2-100N, or 5-80N.

The second locking pair S3, S4 includes two opposite locking surfaces S3, S4, where the first locking surface S3 is the front locking surface 21 of the locking element 16 of the locking strip 15 of the first connecting means 12*a* of the second building panel 1' and the second locking surface S4 is the front wall 36 of the locking groove 35 of the second connecting means 12*c* of the first building panel 1. The second locking pair S3, S4 is configured to create a locking in both the vertical and horizontal direction. The second locking pair S3, S4 is configured to prevent a displacement between the first and second building panel 1, 1'.

The cooperation between the locking strip 15 being angularly displaced during installation and the second locking pair S3, S4, the pretension between the first locking pair S1, S2 is achieved in the assembled position.

The third locking pair S5, S6 includes two opposite locking surfaces S5, S6, where the first locking surface S5 is the upper wall 24 of the tongue groove 23 of the first connecting means 12*a* of the second building panel 1' and the second locking surface S6 is the upper surface 39*a* of the locking tongue 38 of the second connecting means 12*c* of the first building panels 1. The third locking pair S5, S6 is configured to create a locking the vertical direction.

The fourth locking pair S7, S8 includes two opposite locking surfaces S7, S8, where the first locking surface S7 is the upper surface 29 of the upper tongue 28 of the first connecting means 12*a* of the second building panel 1' and the second locking surface S8 is the upper wall 44 of the upper tongue groove 43 of the second connecting means 12*c* of the first building panels 1. The fourth locking pair S7, S8 is configured to create a locking the vertical direction.

In an alternative way of describing the bendable feature of the locking strip 15 a first dimension D1 is measured between a point P1 on the first locking surface S1 of the first locking pair at the upper edge portion 3*a* of the side edge 2*a* of the building panel and a point P3 on the first locking surface S3 of the second locking pair on the locking element 16 in an unassembled position. Further, a second dimension D2 is measured between the same point P1 on the first locking surface S1 of the first locking pair and the point P3 on the first locking surface S3 of the second locking pair in the assembled position. The first dimension D1 is smaller than the second dimension D2.

A third dimension D3 is measured between a point P2 on the second locking surface S2 of the first locking pair and a point P4 on the second locking surface S4 of the second locking pair. The third dimension D3 is greater than the first dimension D1.

FIGS. 6-9*b* illustrate another embodiment of the first pair of connecting means 12*a*, 12*c* which is much similar to the embodiment illustrated in FIGS. 3*a*-5*b* but with some changes in the details.

The mechanical locking device 10 of the assembled first and second building panel 1, 1' has the two compatible connecting means 12*a*, 12*c*, like the previously described mechanical locking device 10.

Figure 8A:
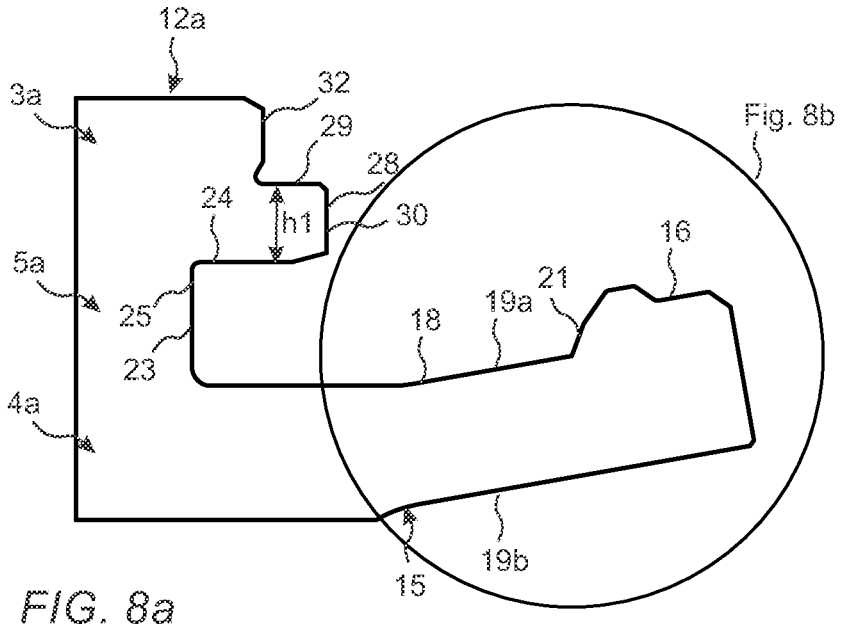
FIGS. 8*a* and 8*b* illustrate a cross section of a first connecting means of the mechanical locking device in FIG. 6, and a detailed view of the connecting means, in an unassembled position.
Figure 8B:
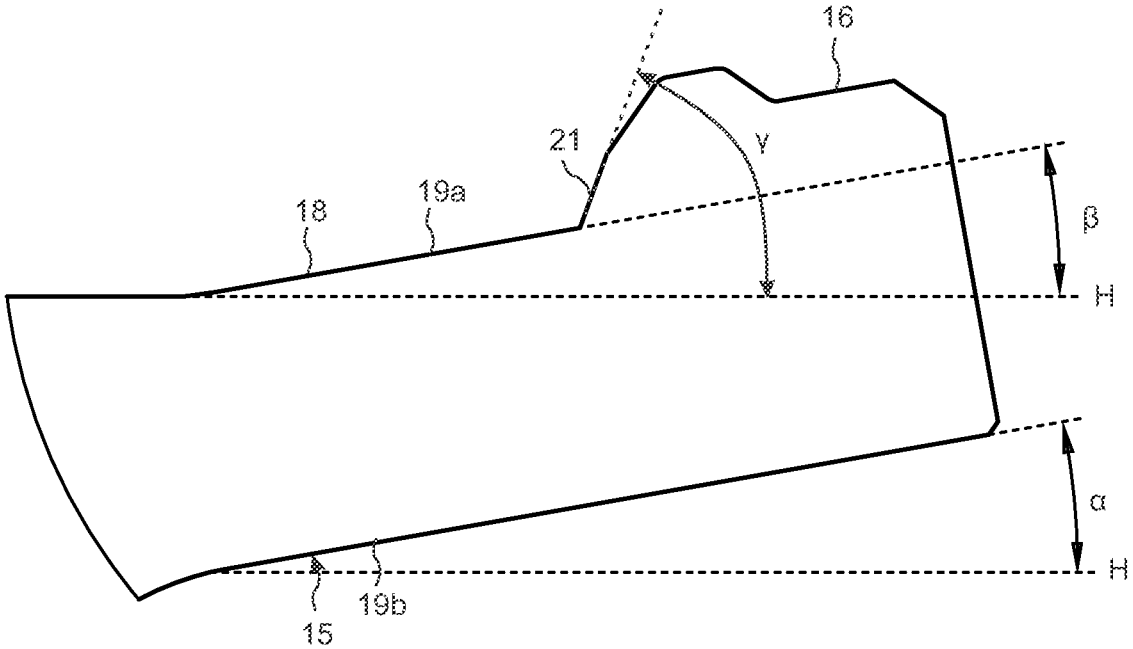

The first connecting means 12*a* of the second building panel 1' has many or all the features of the previously described first connecting means. The difference in this embodiment, illustrated in FIGS. 8*a*, 8*b* and 9*b*, is the shape of the locking strip 15, and especially the shape of the elongated body 18 of the locking strip 15. The bendable function of locking strip 15, and the resulting pretension in the locking surfaces, is however not affected or at least not decreased. The elongated body 18 of the locking strip 15 is still configured to be angularly displaced during the assembly of two building panels 1, 1'.

Figure 9A:
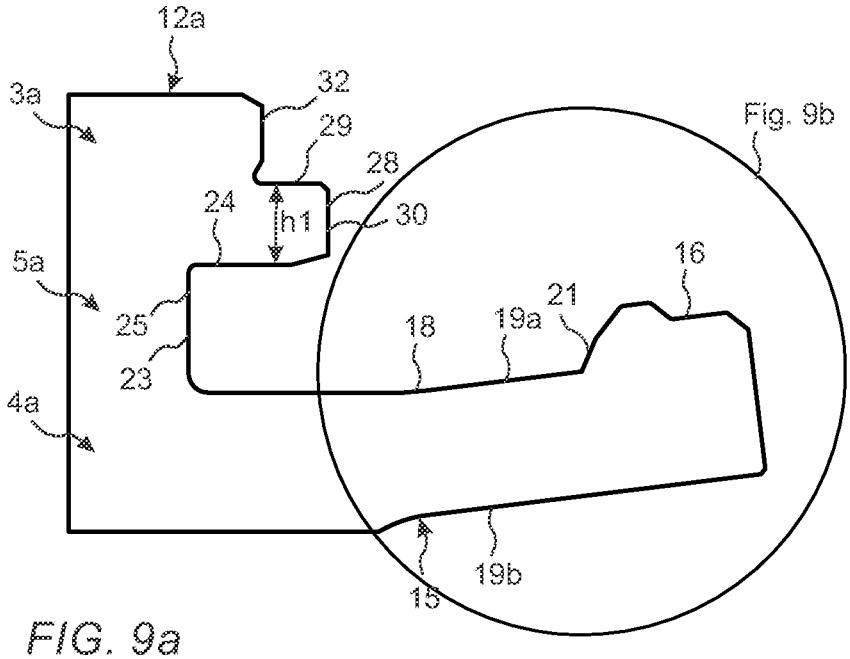
FIGS. 9*a* and 9*b* illustrate the cross section of the first connecting means of the mechanical locking device in FIG. 6 and a detailed view of the connecting means, in an assembled position.
Figure 9B:
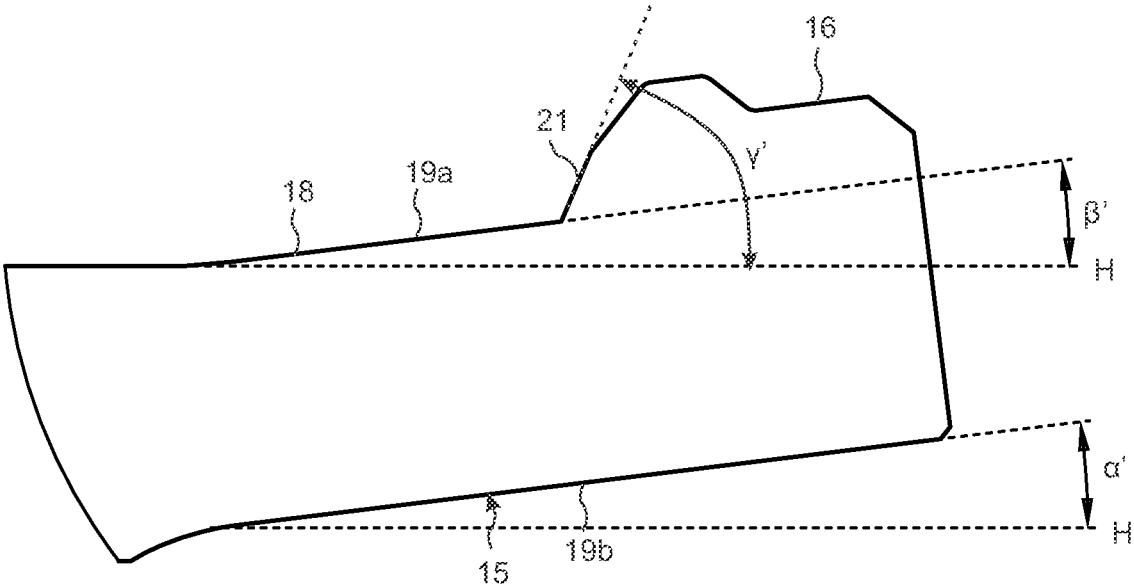

The elongated body 18 is in FIGS. 8*a* and 8*b* illustrated in the unassembled position and in FIGS. 9*a* and 9*b* illustrated in the assembled position. The elongated body 18 has the upper and lower surface 19*a*, 19*b*. The upper and lower surface 19*a*, 19*b* extend, around the innermost end of the elongated body 18, in a substantially horizontal direction. At a point along, as illustrated, moving towards the outermost end, the upper and lower surface 19*a*, 19*b* of the elongated body 18 are shaped at an angle upwards. Optionally, at a point along, moving towards the outermost end, at least the lower surface 19*b* of the elongated body 18 is shaped at an angle upwards. The difference compared to the previously described embodiment is that the upper and lower surface 19*a*, 19*b* are, or at least the lower surface 19*b* is, angled at a greater angle. The upper and lower surface 19*a*, 19*b* are partly shaped at an angle upwards, more in this embodiment than in the embodiment illustrated in FIGS. 3*a*-5*b*.

The first angle α, measured between the lower surface 19*b* of the elongated body 18 of the locking strip 15 and the horizontal axis H, is in the unassembled position within a range about 5° to 20°, within a range about 8° to 15° or within a range about 9° to 11°. During the installation, the first angle α will decrease due to the bendability of the elongated body 18. The difference between the first angle α in the unassembled position and the first angle α' in the assembled position is within a range about 0.5° to 5°, within a range about 1° to 4° or within a range about 2° to 3°.

The second angle β, measured between the upper surface 19*a* of the elongated body 18 of the locking strip 15 and the horizontal axis H is in the unassembled position within a range about 5° to 20°, within a range about 8° to 15° or within a range about 9° to 11°. During the installation, the second angle β will decrease due to the bendability of the elongated body 18 and due to the lower surface 39*b* of the locking tongue of the second connecting means 12*c*, which is formed at an angle θ, pushing on the upper surface 19*a*. The difference between the first angle α in the unassembled position and the first angle α' in the assembled position is within a range about 0.5° to 5°, within a range about 1° to 4° or within a range about 2° to 3°. In other words, the difference between the angle β of the upper surface 19*a* and an angle θ of the lower surface 39*b* decreases during the folding displacement.

The upper surface 19*a*, in the assembled position, extends preferably in the same direction as the lower surface 39*b* of the second connecting means 12*c* pushing on the upper surface 19*a*.

Alternatively, the upper surface 19*a*, in the assembled position, at least partly extends preferably in the same direction as the lower surface 39*b* of the second connecting means 12*c* pushing on the upper surface 19*a*. The upper surface 19*a* of the elongated body 18 of the first connecting means 12*a*, in the assembled position, is configured to cooperate and preferably at least partly be in contact with the lower surface 39*b* of the second connecting means 12*c*.

The upper surface 19*a* of the elongated body 18 and the lower surface 39*b* of the locking tongue 38 are plane, at least in the area where the two surfaces 19*a*, 39*b* cooperate.

The front locking surface 21 of the locking element 16 is shaped to form a third angle γ to the horizontal axis H. The front locking surface 21 is shaped at an angle upwards, in a direction towards the decorative surface layer 8. The third angle γ is in the unassembled position within the range about 45° to 90°. During the installation, the third angle γ will decrease due to the bendability of the elongated body 18. The difference between the third angle γ in the unassembled position and the third angle γ' in the assembled position is within a range about 1° to 5° or within a range about 2° to 3°.

The front locking surface 21 of the locking element 16, in the assembled position, extends preferably in the same direction as a front wall 36 of the locking groove 35 of the second connecting means 12*c*. Alternatively, the front locking surface 21 of the locking element 16, in the assembled position, at least partly extends preferably in the same direction as the front wall 36 of the locking groove 35 of the second connecting means 12*c*. The front locking surface 21 of the locking element 16 of the first connecting means 12*a*, in the assembled position, is configured to cooperate and preferably at least partly be in contact with the front wall 36 of the locking groove 35 of the second connecting means 12*c*.

Figure 7A:
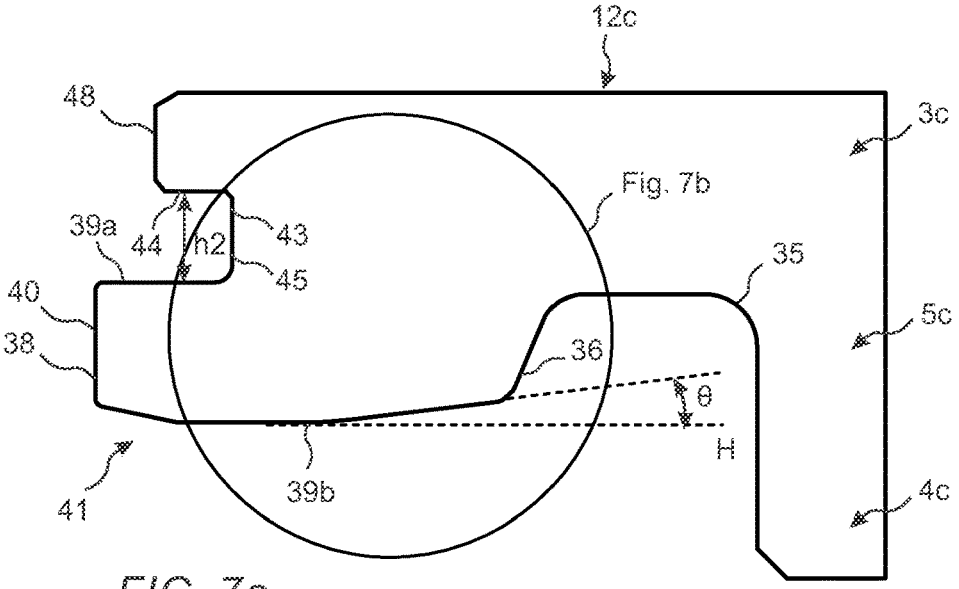
FIGS. 7*a* and 7*b* illustrate a cross section of a second connecting means of the mechanical locking device in FIG. 6 and a detailed view of the connecting means.
Figure 7B:
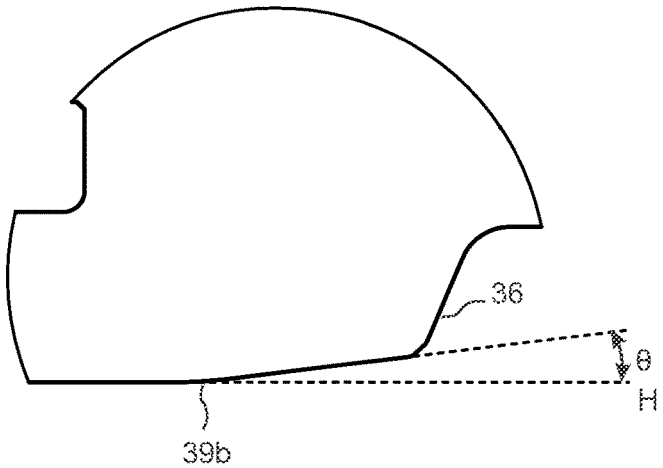

FIG. 8*b* is a detailed view of illustrating the first, second and third angle α, β, γ in the unassembled position and FIG. 9*b* is a detailed view of illustrating the first, second and third angle α', β', γ' in the assembled position. FIGS. 7*a* and 7*b* illustrate the second connecting means 12*c* which also has all the features of the previously described second connecting means. The difference in the embodiment illustrated in FIGS. 7*a* and 7*b* is the shape of the lower surface 39*b* of the locking tongue 38. The lower surface 39*b* may have different parts shaped at different angles, e.g., a middle part may be substantially horizontal and an innermost part may be shaped at an angle θ upwards, towards the decorative surface layer 8. The innermost part of the lower surface 39*b* is configured to cooperate and preferably be in contact with the angled upper surface 19*a* of the elongated body 18 of the locking strip 15 of the first connecting means 12*a* of the adjacent building panel. During installation the lower surface 39*b* is configured to displace, and preferably push on, the upper surface 19*a* of the elongated body 18 of the locking strip 15. In the assembled position the angle β' of the upper surface 19*a* is essentially the same as the angle θ of the lower surface 39*b* of the locking tongue 38. Thus, the upper surface 19*a* and the lower surface 39*b*, in the area where they cooperate, are substantially parallel in the assembled position. In other words, the difference between the angle β of the upper surface 19*a* and an angle θ of the lower surface 39*b* decreases during the assembling of the first and second building panels 1, 1'.

Further, the upper surface 19*a* of the elongated body 18, in the assembled position and at least in the area where the upper surface cooperates with the lower surface 39*b* of the locking tongue 38, extends in the same direction as the lower surface 39*b* of the locking tongue 38. Alternatively, the upper surface 19*a*, in the assembled position, at least partly extends in the same direction as the lower surface 39*b*.

Figure 10:
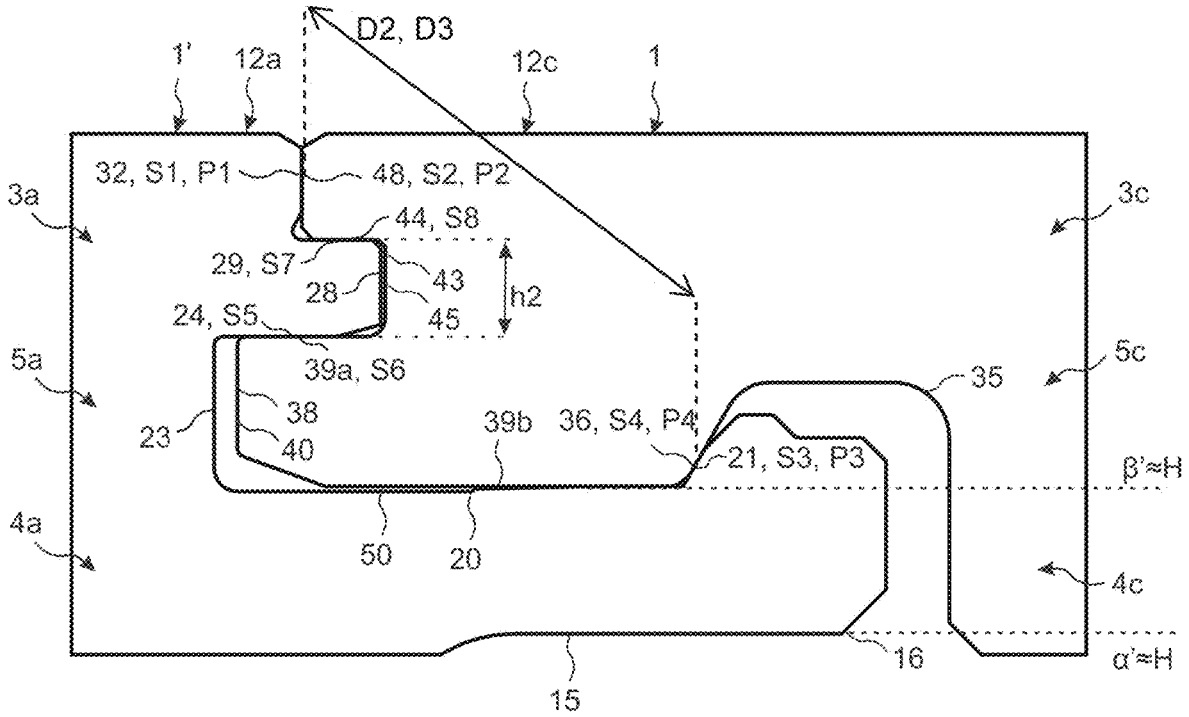
FIG. 10 illustrates a cross section of a mechanical locking device according to yet another embodiment of the inventive concept.

FIG. 10 illustrates another embodiment of the first pair of connecting means 12*a*, 12*c* of the inventive concept, in the assembled position. In this embodiment the second connecting means 12*c* is similar or even identical to the second connecting means of the embodiment, illustrated in FIG. 4 and described above.

Figure 11:
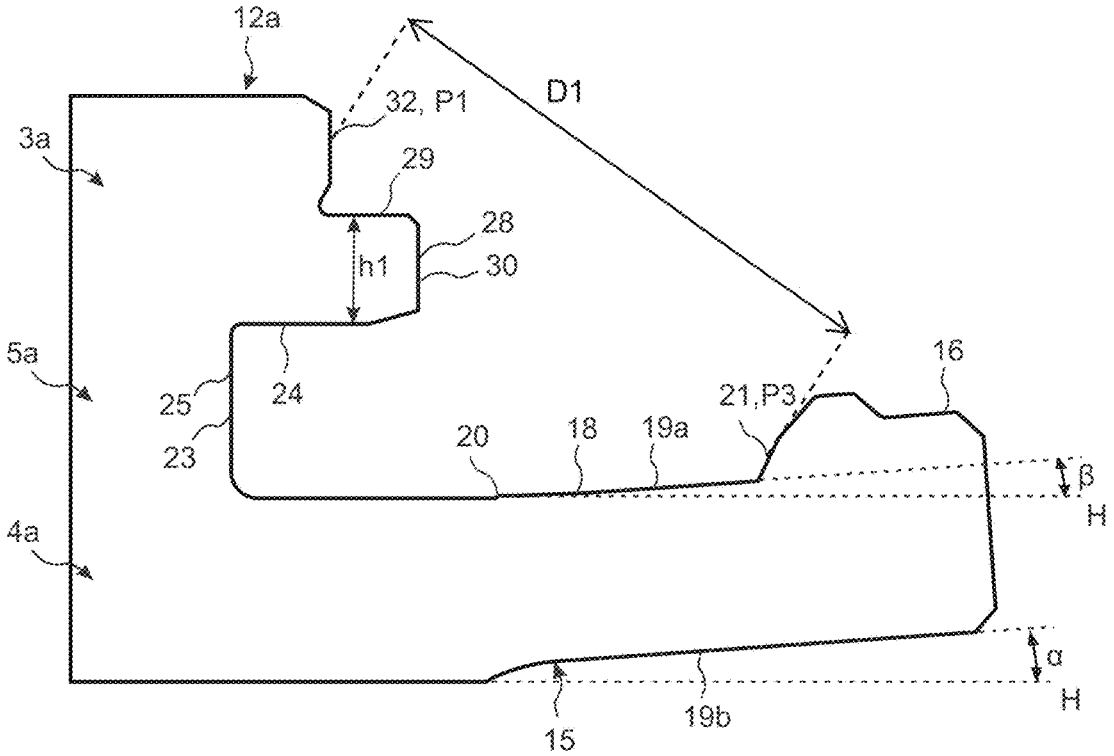
FIG. 11 illustrates a cross section of a first connecting means of the mechanical locking device in FIG. 10, in an unassembled position.

The first connecting means 12*a* in this embodiment, illustrated in FIG. 11, is similar to the first connecting means of the embodiment, illustrated in FIGS. 3*a*-3*c* but with an additional elevation 20 provided on the upper surface 19*a* of the strip 15. The upper surface 19*a*, in the illustrated embodiment, has an essentially horizontal extension from the innermost end of the elongated body 18 of the strip 15. At one point along the extension of the elongated body 18, in the direction towards the locking element 16, there is provided an elevation 20. After the elevation 20 the upper surface 19*a* continues shaped at an angle β upwards. The elevation 20 is provided to create a gap 50 between the upper surface 19*a* of the strip 15 of the first connecting means 12*a* and the lower surface 39*b* of the second connecting means 12*d* of the adjacent building panel, in the assembled position. The elevation 20 preferably has a height between 0.03 and 0.15 mm. The gap 50 is provided to create desirable and controllable sealings between the connecting means 12*a*, 12*c*. Such sealing occurs in the area around where the locking strip 15 meets the lower surface 39*b*, in the area around where the upper wall 24 meets the upper surface 39*a* and/or in the area around where the upper surface 29 meets the upper wall 44.

FIGS. 12-14*b* illustrate an embodiment of the inventive concept of the second pair of connecting means 12*b*, 12*d* briefly introduced above. Much is similar to the first pair of connecting means 12*a*, 12*c* and previously described embodiments. The second pair of connecting means 12*b*, 12*d* are, in the illustrated panel in FIG. 1, arranged along the short side edges 2*b*, 2*d* of the building panels 1, 1', 1". The two connecting means 12*b*, 12*d* of the mechanical locking device 10, arranged on the two opposite side edges 2*b*, 2*d*, are compatible with each other.

The second pair of connecting means 12*b*, 12*d* is configured to assemble and lock adjacent building panels 1, 1', 1" in a horizontal and vertical direction by means of the vertical displacement. The assembling is described in more detail above, with reference to FIGS. 2*a*-2*c*.

Figure 12:
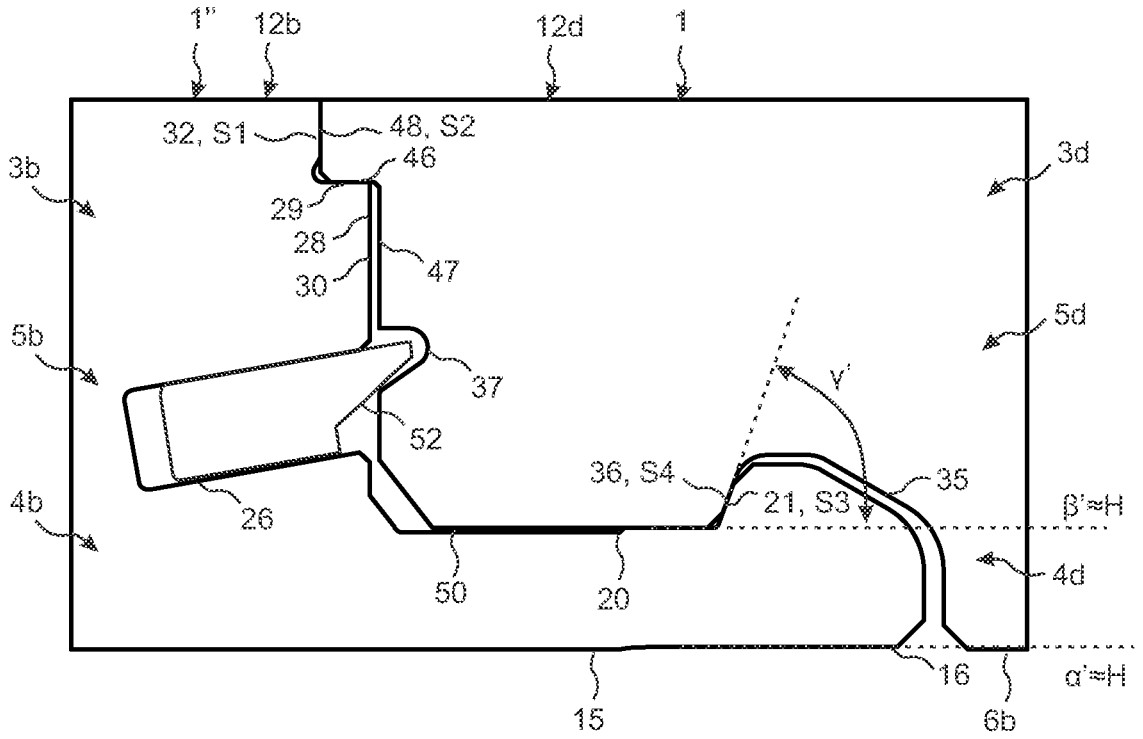
FIG. 12 illustrates a cross section of a mechanical locking device according to an embodiment of the inventive concept.
Figure 13:
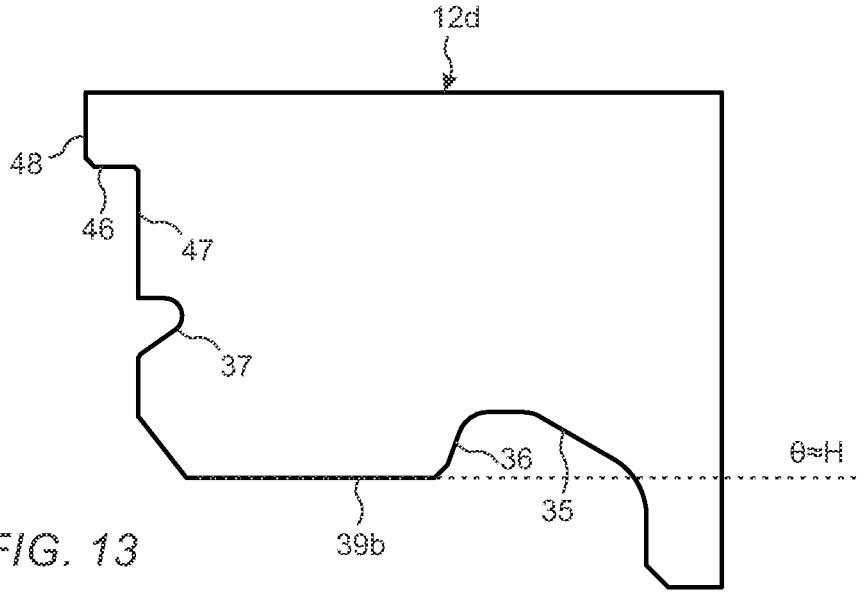
FIG. 13 illustrates the cross sections of a second connecting means of the mechanical locking device in FIG. 12, FIGS. 14*a* and 14*b* illustrate the cross section of a first connecting means of the mechanical locking device in FIG. 12 and a detailed view of the connecting means, in an unassembled position.
Figure 14A:
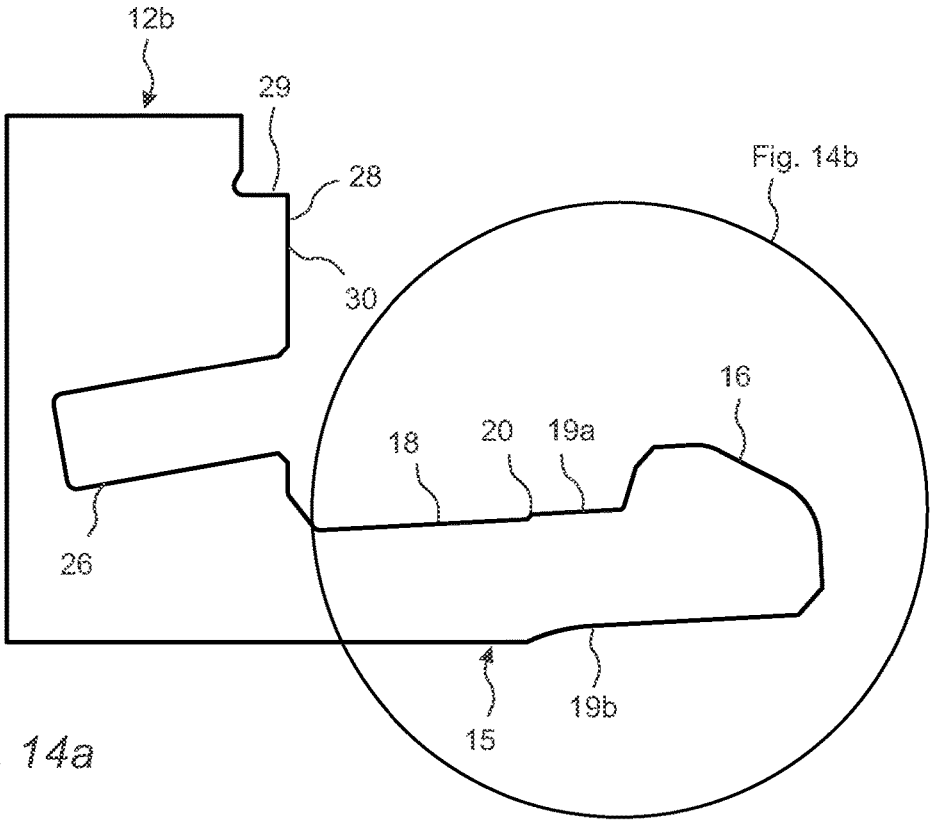
Figure 14B:
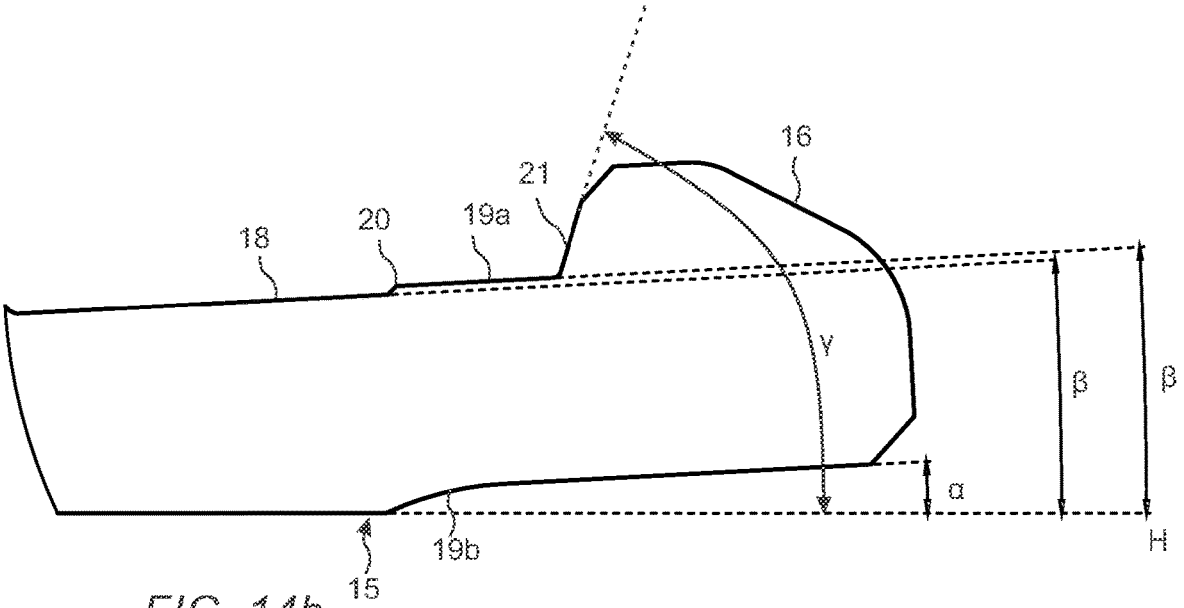

FIGS. 14*a* and 14*b* illustrate the first connecting means 12*b* of the second pair of connecting means of the mechanical locking device 10, in the unassembled position. FIG. 13 illustrates the second connecting means 12*b* of the second pair of connecting means of the mechanical locking device 10, in the unassembled position. FIG. 12 illustrates the first connecting means 12*b* of the third building panel 1" and the second connecting means 12*d* of the first building panel 1, in the assembled position.

The first connecting means 12*b* is integrally formed at the side edge 2*b* of the building panel. The second connecting means 12*d* is integrally formed at the opposite side edge 2*d* of the building panel.

The first connecting means 12*b* includes a locking strip 15, preferably integrally formed in the side edge 2*b* of the building panel. The locking strip 15 is arranged at a lower edge portion 4*b* of the side edge 2*b*, projecting outwards from the lower edge portion 4*b*. The locking strip 15 is configured to be angularly displaced during the vertical displacement, as explained in more detail below.

The locking strip 15 includes, at the outmost end of the locking strip 15, a locking element 16. The locking element 16 is configured to be received in a locking groove 35 arranged in a lower edge portion 4*d* of the side edge 2*d* of an adjacent building panel, by means of the vertical displacement.

The locking strip 15 has an elongated shape with the locking element 16 arranged at the outermost end. Between the innermost end of the locking strip 15 and the locking element 16 the locking strip 15 has an elongated body 18. The elongated body 18 has an upper surface 19*a* facing the frontside 6*a* of the building panel and a lower surface 19*b* facing the backside 6*b* of the building panel.

The elongated body 18 is configured to be bendable, to the extent that the elongated body 18 during installation of two building panels 1, 1" may be pushed and displaced downwards by the second connecting means 12*d*.

The lower surface 19*b* extends, at the innermost end of the elongated body 18, in a substantially horizontal direction. At a point along, moving towards the outermost end, the elongated body 18 the lower surface 19*b* are shaped to form the first angle α to the horizontal axis H, in a direction towards the decorative surface layer 8. The lower surface 19*b* of the elongated body 18 is slightly shaped at an angle upwards. The first angle α is in the unassembled position is within a range about 0.5° to 5°, within a range about 1° to 4° or within a range about 2° to 3°. During the installation, as illustrated in FIGS. 5*a* and 5*b*, the first angle α will decrease due to the bendability of the elongated body 18. The first angle α', in the assembled position is within a range about −2° to 2°, within a range about −1° to 1° or about 0°. The difference between the first angle α in the unassembled position and the first angle α' in the assembled position is within a range about 0.5° to 5°, within a range about 1° to 4° or within a range about 2° to 3°.

The upper surface 19*a*, in the illustrated embodiment, is shaped at an angle β upwards from the innermost end of the elongated body 18 out towards the outermost end of the elongated body 18. At one point along the extension of the elongated body 18 there is provided an elevation 20. After the elevation 20 the upper surface 19*a* continues in the same direction as before the elevation 20, i.e., at the same angle β. This is illustrated in more detail in FIG. 14*b*. The elevation 20 is provided to create a gap 50 between the upper surface 19*a* of the first connecting means 12*b* and the lower surface 39*b* of the second connecting means 12*d* in the assembled position. The elevation 20 preferably has a height between 0.03 and 0.15 mm. The gap 50 is provided to create desirable and controllable sealings between the connecting means 12*a*, 12*c*. Such sealing occurs in the area around where the locking strip 15 meets the lower surface 39*b*, in the area around where the upper wall 24 meets the upper surface 39*a* and/or in the area around where the upper surface 29 meets the upper wall 44.

Alternatively, the shape of the elongated body may be the same as explained above relating to FIG. 11, i.e., the elongated body 18 has a essentially horizontal extension from the innermost end and after the elevation 20 shaped at the angle β.

The upper surface 19*a* of the elongated body 18 of the locking strip 15 is shaped to form the second angle β to the horizontal axis H. The second angle β is in the unassembled position within a range about 0.5° to 5°, within a range about 1° to 4° or within a range about 2° to 3°. The elongated body 18 of the locking strip 15 is configured to be angularly displaced during the installation. During the installation, the second angle β will decrease due to the bendability of the elongated body 18 and due to the lower surface 39*b* of the second connecting means 12*d* pushing on the upper surface 19*a*. The second angle β', in the assembled position is within a range about −2° to 2°, within a range about −1° to 1° or about 0°. The difference between the first angle α in the unassembled position and the first angle α' in the assembled position is within a range about 0.5° to 5°, within a range about 1° to 4° or within a range about 2° to 3°.

The lower surface 39*b* of the second connecting means 32*d* may be formed at an angle θ. However, in the illustrated embodiment in FIG. 13 the angle θ is essentially 0°, i.e., essentially parallel to the horizontal axis H. The angle θ is in the unassembled position within a range about −5° to 5°, within a range about −3° to 3° or within a range about −1° to 1°, in relation to a horizontal axis H. The difference between the angle β of the upper surface 19*a* and an angle θ of the lower surface 39*b* decreases during the assembling of the first and third building panel 1, 1".

The upper surface 19*a*, in the assembled position, extends preferably in the same direction as the lower surface 39*b* of the second connecting means 12*d* pushing on the upper surface 19*a*. Alternatively, the upper surface 19*a*, in the assembled position, at least partly extends in the same direction as the lower surface 39*b* of the second connecting means 12*d* pushing on the upper surface 19*a*.

The upper surface 19*a*, after the elevation 20, of the elongated body 18 of the first connecting means 12*a*, in the assembled position, is configured to cooperate and preferably at least partly be in contact with the lower surface 39*b* of the second connecting means 12*d*. Between the lower surface 39*b* of the second connecting means 12*d* and the upper surface 19*a*, before the elevation 20, of the first connecting means 12*b* the gap 50 is formed.

The locking element 16 of the locking strip 15 includes a front locking surface 21. The front locking surface 21 is arranged at the innermost end of the locking element 16. The upper surface 19*a* of the elongated body 18 merges into the front locking surface 21 of the locking element 16.

The front locking surface 21 of the locking element 16 is shaped to form a third angle γ to the horizontal axis H. The front locking surface 21 is shaped at an angle upwards, in a direction towards the decorative surface layer 8. The third angle γ is in the unassembled position within the range about 45° to 90°. During the installation the third angle γ will decrease due to the bendability of the elongated body 18. The difference between the third angle γ in the unassembled position and the third angle γ' in the assembled position is within a range about 1° to 5° or within a range about 2° to 3°.

The front locking surface 21 of the locking element 16, in the assembled position, extends preferably in the same direction as a front wall 36 of the locking groove 35 of the second connecting means 12*d*. Alternatively, the front locking surface 21 of the locking element 16, in the assembled position, at least partly extends preferably in the same direction as the front wall 36 of the locking groove 35 of the second connecting means 12*d*. The front locking surface 21 of the locking element 16 of the first connecting means 12*b*, in the assembled position, is configured to cooperate and preferably at least partly be in contact with the front wall 36 of the locking groove 35 of the second connecting means 12*d*.

In an alternative way of describing the bendable feature of the locking strip 15 a first dimension D1 is measured between a point P1 on the first locking surface S1 of the first locking pair at the upper edge portion 3*b* of the side edge 2*b* of the building panel 1 and a point P3 on the first locking surface S3 of the second locking pair on the locking element 16 in an unassembled position. Further, a second dimension D2 is measured between the same point P1 on the first locking surface S1 of the first locking pair and the point P3 on the first locking surface S3 of the second locking pair in the assembled position. The first dimension D1 is smaller than the second dimension D2.

A third dimension D3 is measured between a point P2 on the second locking surface S2 of the first locking pair and a point P4 on the second locking surface S4 of the second locking pair. The third dimension D3 is greater than the first dimension D1.

The first connecting means 12*b* further includes a displaceable tongue groove 26. The displaceable tongue groove 26 is arranged in the intermediate edge portion 5*b* of the side edge 2*b* of the building panel and extends inwards into the side edge 2*b*. The displaceable tongue groove 26 is arranged above the locking strip 15, at the innermost end of the locking strip 15.

The displaceable tongue groove 26 is configured and shaped to receive a displaceable locking tongue 52. The displaceable locking tongue 52 is configured to lock the first and third building panel 1, 1" in the vertical and horizontal direction.

The displaceable locking tongue 52 may be a separate member and comprise the same or a different material than the building panel. The displaceable locking tongue 52 may be made of a polymer-based material.

The first connecting means 12*b* further includes an upper tongue 28. The upper tongue 28 is arranged in the intermediate and/or upper edge portion 5*b*, 3*b* of the side edge 2*b* of the building panel and extends outwards away from the side edge 2*b*. The upper tongue 28 is arranged above the displaceable tongue groove 26.

The upper tongue 28 has an upper surface 29 which is configured to cooperate and preferably be in contact with a lower surface 46, arranged in the upper edge portion 3*d*, of the second connecting means 12*d* of the building panel. Perpendicular to the lower surface 46 of the second connecting means 12*d* there is provided a front surface 47.

In the assembled position, the upper tongue 28 is configured to be vertically locked by means of the lower surface 46.

At the upper edge portion 3*b* of the side edge 2*b* of the building panel there is provided an essentially vertical locking surface 32. At the opposite upper edge portion 3*d* of the side edge 2*d* of the adjacent building panel 1 there is provided an opposite essentially vertical locking surface 48. The locking surface 32 of the building panel 1" is configured to cooperate, and preferably be in contact with the locking surface 48 of the adjacent building panel 1. Together, the locking surface 32 of the third building panel 1" and the locking surface of the first panel 1 form the first locking pair S1, S2, as explained in detail above.

Although many of the features of the second connecting means 12*d* has been described above, additional features are now described in more detail.

The second connecting means 12*d* of the second pair of connecting means includes the locking groove 35. The locking groove 35 is arranged in the lower edge portion 4*d* of the side edge 2*d* of the building panel and extends upwards into and away from the backside 6*b* of the building panel.

The locking groove 35 is configured and shaped to receive the locking element 16 of the locking strip 15 of the first connecting means 12*b*. In the assembled position, the locking groove 35 is configured to vertically and preferably horizontally lock the locking element 16. In order to do so the locking groove 36, in the illustrated embodiments, includes a front wall 36. The front wall 36 is configured to, in the assembled position, cooperate and preferably at least partly be in contact with the front locking surface 21 of the locking element 16 of the first connecting means 12*b* of the adjacent building panel. Together, the front wall 36 of the locking groove 35 of the second connecting means 12*d* and the front locking surface 21 of the locking element 16 of the first connecting means 12*b* form the second locking pair S3, S4, as explained in detail above.

The front wall 36 of the locking groove 35 is a sloped wall which is configured to engage the front locking surface 21 of the locking element 16 during the installation. In the assembled position the angle γ' of the front locking surface 21 is essentially the same as the angle of the sloped front wall 36.

The second connecting means 12*d* further has the lower surface 39*b* as mentioned above. The lower surface 39*b* is arranged in the intermediate edge portion 5*d* of the building panel. The lower surface 39*b* is in this embodiment a surface extending in the horizontal plane H, but may in another embodiment be arranged at an angle to the horizontal plane. The lower surface 39*b* merges at an innermost end with the front wall 36 of the locking groove 35. The lower surface 39*b* is configured to at least partly push on the upper surface 19*a* of the elongated body 18. The lower surface 39*b* of the second connecting means 12*d* is configured to cooperate and preferably at least partly be in contact with the upper surface 19*a* of the elongated body 18 of the first connecting means 12*b* in the assembled position.

The lower surface 39*b* may be formed at an angle θ. However, in the illustrated embodiment in FIG. 13 the angle θ is essentially 0°, i.e., essentially parallel to the horizontal axis H. The angle θ is in the unassembled position within a range about −5° to 5°, within a range about −3° to 3° or within a range about −1° to 1°, in relation to a horizontal axis H. The difference between the angle β of the upper surface 19*a* and an angle θ of the lower surface 39*b* decreases during the assembling of the first and third building panel 1, 1".

In the intermediate edge portion 5*d* of the second connecting means 12*d* there is also provided a displaceable tongue groove 37. The displaceable tongue groove 37 is arranged below the front surface 47, arranged from the upper edge portion 3*d* down to the intermediate edge portion 5*d*. The displaceable tongue groove 37 is shaped and configured to receive the displaceable locking tongue 52, explained in more detail below. The displaceable tongue groove 37 extends along the extension of the side edge 2*d* of the building panel.

The displaceable tongue groove 37 is configured to, together with the displaceable locking tongue 52, lock the first building panel 1 to the third building panel 1" in the horizontal and vertical direction.

Above the displaceable tongue groove 37 the front surface 47 extends in the vertical direction up towards the decorative surface layer 8.

Above and perpendicular to the front surface 47 of the second connecting means 12*d* there is provided the lower surface 46. The lower surface 46 is arranged in the upper edge portion 3*d* of the building panel. The lower surface 46 faces down towards the backside 6*b* of the building panel. The lower surface 46 is configured to vertically lock the upper surface 29 of the upper tongue 28 of the first connecting means 12*a* in the assembled position. The lower surface 46 is configured to cooperate and preferably be in contact with the upper surface 29 of the upper tongue in the assembled position. Together, the lower surface 46 of the second connecting means 12*d* and the upper surface 29 of the upper tongue 28 of the first connecting means 12*b* form the fourth locking pair S7, S8, as explained in detail above.

At the upper edge portion 3*d* of the side edge 2*d* of the building panel 1 there is provided the essentially vertical locking surface 48 which is configured to cooperate and preferably be in contact with the opposite essentially vertical locking surface 32 of the side edge 2*b* of the adjacent building panel 1". Together, the locking surface 32 of the third building panel 1" and the locking surface 48 of the first panel 1 form the first locking pair S1, S2, as explained in detail above.

Figure 15:
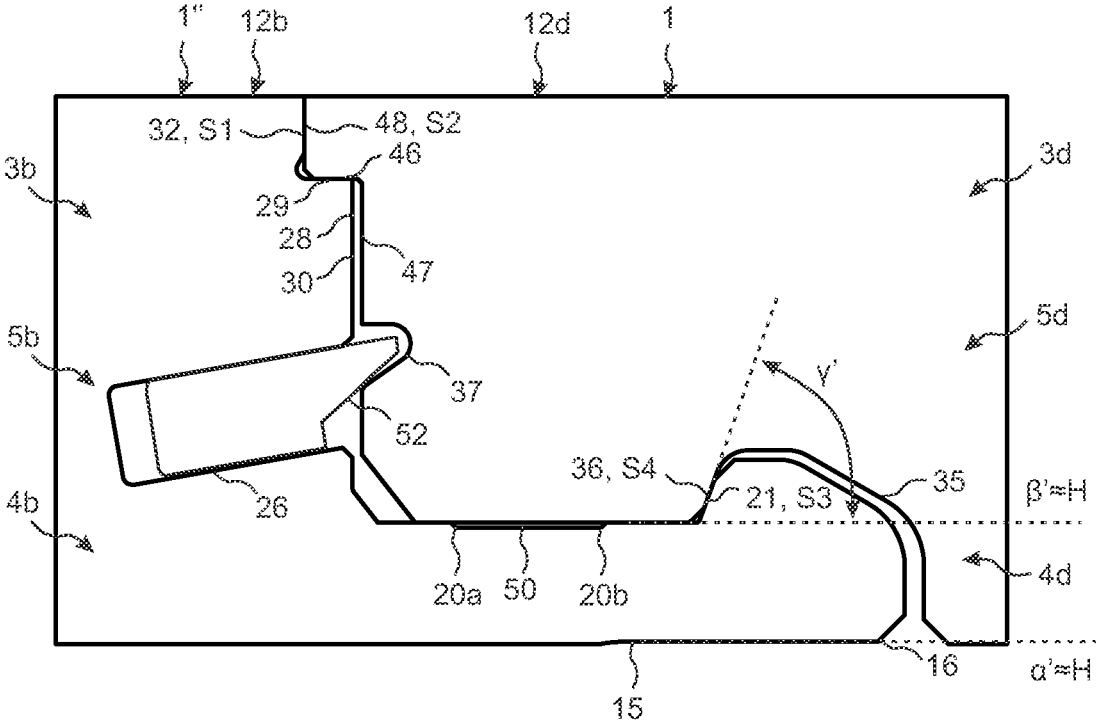
FIG. 15 illustrates a cross section of a mechanical locking device according to another embodiment of the inventive concept.

FIG. 15 illustrates another embodiment of the second pair of connecting means 12*b*, 12*d* of the inventive concept, in the assembled position. In this embodiment the second connecting means 12*d* is similar or even identical to the second connecting means of the embodiment, illustrated in FIG. 13 and described above.

Figure 16:
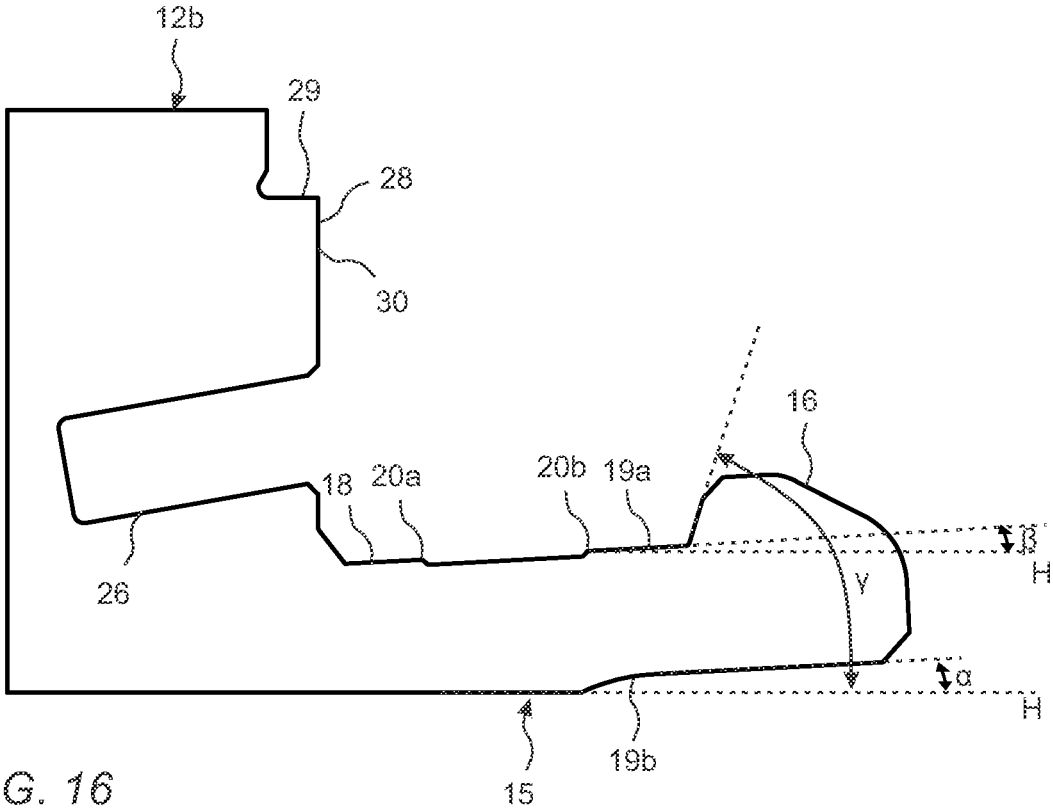
FIG. 16 illustrates the cross sections of a first connecting means of the mechanical locking device in FIG. 15, in an unassembled position.

The first connecting means 12*a* in this embodiment, illustrated in FIG. 16, is similar to the first connecting means of the embodiment, illustrated in FIGS. 14*a*-14*b* but with an additional immersion 20*a* provided on the upper surface 19*a* of the strip 15. The immersion 20*a* is provided opposite the elevation 20*b*, towards the innermost end of the elongated body 18, along the extension of the upper surface 19*a* of the elongated body 18. At one point along the extension of the elongated body 18, in the direction towards the locking element 16, there is provided, first the immersion 20*a* and later the elevation 20*b*. After the elevation 20*b* the upper surface 19*a* continues shaped at an angle β upwards.

The immersion 20*a* and the elevation 20*b* are provided to create a gap 50 between the upper surface 19*a* of the strip 15 of the first connecting means 12*a* and the lower surface 39*b* of the second connecting means 12*d*, in the assembled position. The immersion 20*a* and the elevation 20*b*, respectively preferably has a height between 0.03 and 0.15 mm. The gap 50 is provided to create desirable and controllable sealings between the connecting means 12*a*, 12*c*. Such sealing occurs in the area around where the locking strip 15 meets the lower surface 39*b*, in the area around where the upper wall 24 meets the upper surface 39*a* and/or in the area around where the upper surface 29 meets the upper wall 44. The connecting means 12*b*, 12*d* of the embodiment illustrated in FIGS. 15 and 16 are, except from the feature described above, similar or even identical to the connecting means 12*b*, 12*d* of the embodiment illustrated in FIGS. 12-14*b* and described above.

Figure 17:
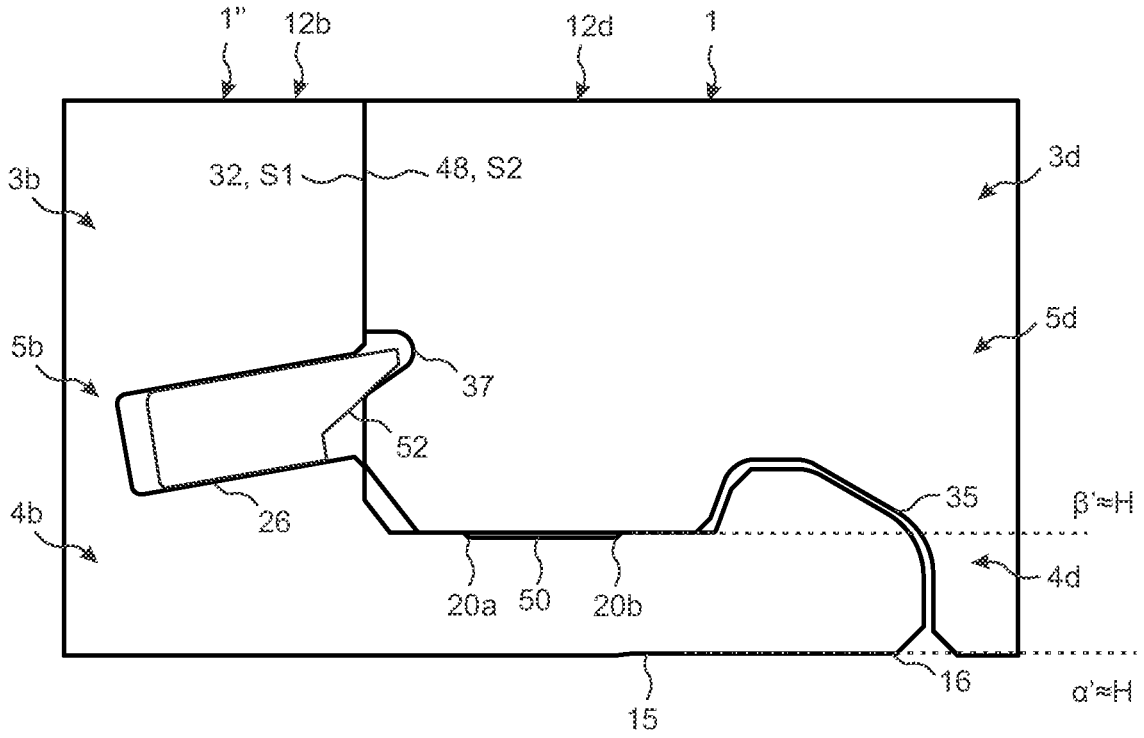
FIG. 17 illustrates a cross section of a mechanical locking device according to yet another embodiment of the inventive concept.

FIG. 17 illustrates yet another embodiment of the second pair of connecting means 12*b*, 12*d* of the inventive concept, in the assembled position.

The first connecting means 12*b* and the second connecting means 12*d* is similar to the respective connecting means of the embodiments, illustrated in FIGS. 12 and 15 and described above. The difference from the previously described embodiment is the features provided in the upper edge portions 3*b*, 3*d*.

At the upper edge portion 3*b* of the side edge 2*b* of the building panel and at the opposite upper edge portion 3*d* of the side edge 2*d* of the building panel there is provided only the essentially vertical locking surfaces 32, 48. The locking surfaces 32, 48 of two adjacent building panels 1, 1" are configured to cooperate, and preferably be in contact with each other, in the assembled position. Together, the locking surfaces 32, 48 of the adjacent building panels 1, 1" form the first locking pair S1, S2, as explained in detail above.

Figure 18:
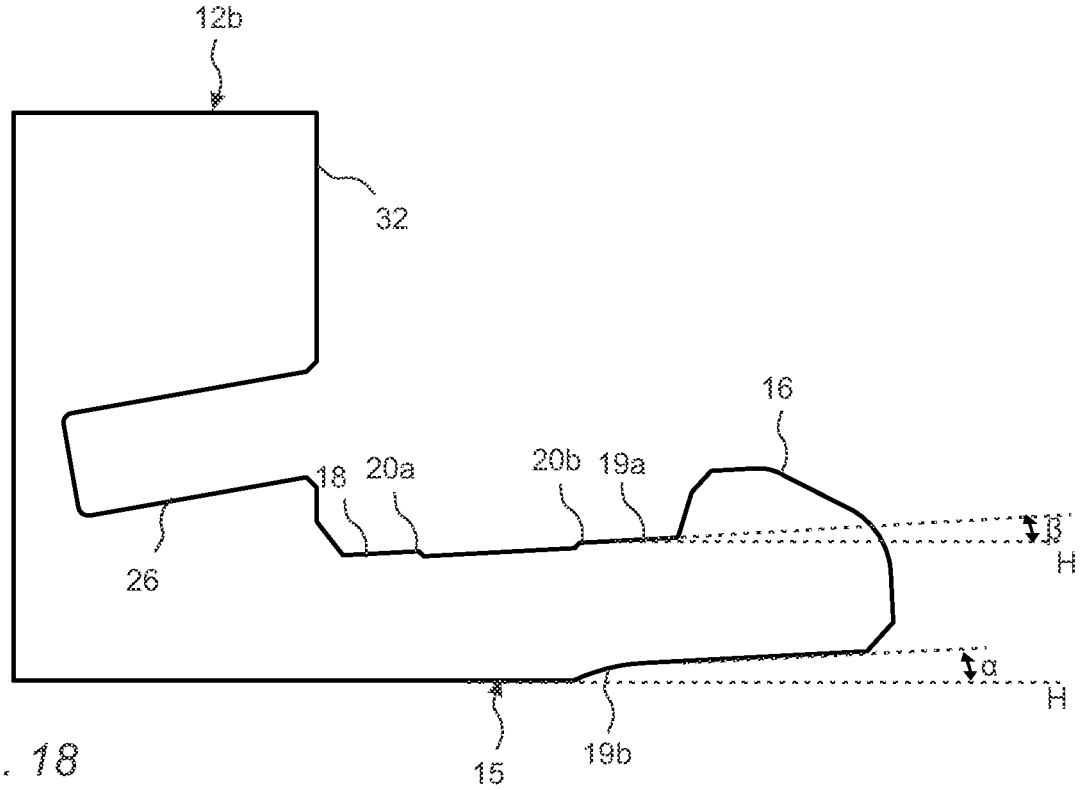
FIG. 18 illustrates the cross sections of a first connecting means of the mechanical locking device in FIG. 17, in an unassembled position.

Although, the embodiment illustrated in FIGS. 17 and 18 has the features of the immersion 20*a* and the elevation 20*b* it is equally possible to have only the feature of the elevation 20 as illustrated in FIGS. 14*a* and 14*b*.

The connecting means 12*b*, 12*d* of the embodiment illustrated in FIGS. 17 and 18 are, except from the features described above, similar or even identical to the connecting means 12*b*, 12*d* of the embodiments illustrated in FIGS. 12-16 and described above.

The major difference between the embodiments illustrated in FIGS. 12-18 and the embodiments described before them is the displaceable locking tongue 52. The displaceable locking tongue 52 is shaped and configured to be received in the displaceable tongue groove 26 of the first connecting means 12*b* and in the displaceable tongue groove 37 of the second connecting means 12*d*.

The displaceable locking tongue 52 is, in the illustrated example, a separate part from the rest of the mechanical locking device 10. The displaceable locking tongue 52 may comprise the same or a different material than the building panel. The displaceable locking tongue 52 may be made of a polymer-based material.

Figure 19:
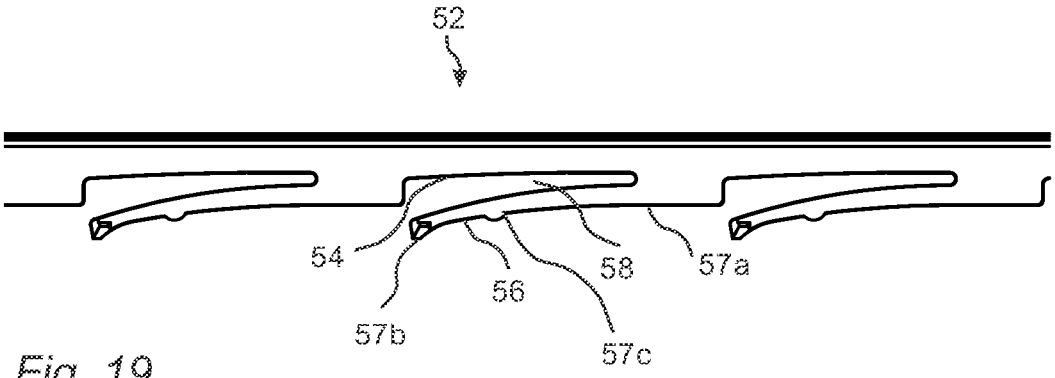
FIG. 19 is a front view of a displaceable locking tongue according to an embodiment of the inventive concept.

Illustrated in FIG. 19, the displaceable locking tongue 52 has a longitudinal base portion 54 which continuously extends along the length of the displaceable locking tongue 52. Along the base portion 54 several elongated flexible or bendable parts 56 are provided. The elongated bendable parts 56 are integrally formed with the base portion 54 at a first end 57*a*. The opposite second end 57*b* of the bendable part 56 is configured to move freely between a resting position and an assembled position.

In the resting position, as illustrated in FIG. 19, the elongated bendable parts 56 extend away from the base portion 54, with the second end 57*b* farthest away from the base portion 54. In between the first end 57*a* and the second end 57*b* the elongated body 57*c* of the bendable part 56 is provided.

Between the elongated bendable part 56 and the base portion 54 there is provided a slot or a gap 58, in the resting position. The bendable part 56 may bend downwards in the slot 58 towards the base portion 54. In an assembled position the bendable parts 56 are bent into the slot 58.

The displaceable locking tongue 52 is configured to be received in the displaceable tongue groove 26 of the first connecting means 12*b* and in the displaceable tongue groove 37 of the second connecting means 12*d*.

Before assembling the first and third building panel 1, 1" the displaceable locking tongue 52 is arranged in the displaceable tongue groove 26 of the first connecting means 12*b*, with the bendable parts 56 facing into the displaceable tongue groove 26 and the longitudinal base portion 54 arranged just outside the displaceable tongue groove 26, facing the building panel 1 to be assembled.

During installation, the first building panel 1 is vertically pushed down into the third building panel 1", where the intermediate edge portion 5*d* of the first building panel 1 pushes on the base portion 54, forcing the bendable parts 56 to be displaced into the slot 58 towards the base portion 54, allowing the intermediate edge portion 5*d* of the first building panel 1 to continue down. When the first building panel 1 is in the assembled position the longitudinal base portion 54 of the displaceable locking tongue 52 snaps into the displaceable tongue groove 37 of the second connecting means 12*d* of the first building panel 1, locking the two building panels 1, 1" in the horizontal and vertical direction.

The description regarding the locking pairs, S1, S2, S3, S4, S5, S6, S7, S8 are applicable for some or all embodiments of this detailed description.

In an embodiment it is preferred that the pretension between the first pair of locking surfaces S1, S2 along the first pair of opposite side edges 2*a*, 2*c* is greater than the pretension between the first pair of locking surfaces S1, S2 along the second pair of opposite side edges 2*b*, 2*d*. In such an embodiment the first pair of side edges 2*a*, 2*c* may be the long sides of a building panel 1, and the second pair of side edges 2*b*, 2*d* may be the short sides of the building panel 1. In such an embodiment the first pair of side edges 2*a*, 2*c* may be provided with the first pair of connecting means 12*a*, 12*c* as illustrated in any of the FIGS. 3*a*-11 and the second pair of side edges 2*b*, 2*d* may be provided with the second pair of connecting means 12*b*, 12*d*, as illustrated in any of the FIGS. 12-18. Due to the folding displacement used during assembling two adjacent building panels with the first pair of connecting means 12*a*, 12*c* the pretension may be increased compared to the vertical displacement used during assembling two adjacent building panels with the second pair of connecting means 12*b*, 12*d*.

An optional way of controlling and creating the desirable pretension in order to create the desirable sealing between two adjacent building panel 1, 1', 1" is to choose materials for each component of the building panel providing those desirable properties. An example may be to have a more flexible or more rigid material in the locking strip in order to affect the bendability of it during the assembling of the building panels.

The panels may be floorboards, wall panels, ceiling panels, a furniture component, or the like.

The substrate 7 of each of the building panels 1, 1', 1" may be a wood-based substrate, such as comprising an HDF board, a particle board, or a plywood material.

The substrate 7 of each of the building panels 1, 1', 1" may be a polymer-based substrate, such as comprising a thermoplastic material, and preferably a filler, or a thermosetting material. For example, the thermoplastic material may comprise PVC and the thermosetting material may comprise a melamine formaldehyde resin.

The substrate 7 of each of the building panels 1, 1', 1" may be a mineral-based substrate, such as comprising magnesium oxide and, optionally, magnesium chloride, e.g., $MgCl_2$, and/or magnesium sulfate, e.g., $MgSO_4$.

The thickness of the building panels 1, 1', 1" may be in the range of about 3 mm to about 10 mm, and preferably in the range of about 4 mm to about 8 mm.

Finally, although the inventive concept has been described above with reference to specific embodiments, it is not intended to be limited to the specific form set forth herein. Rather, the invention is limited only by the accompanying claims. Other embodiments than the specific above are equally possible within the scope of the appended claims. All embodiments may be used separately or in combinations. Angles, dimensions, rounded parts, spaces between surfaces, etc. are only examples and may be adjusted within the basic principles of the invention.

The invention claimed is:

1. A set of building panels, wherein each building panel comprises a decorative surface and a mechanical locking device for horizontal and vertical locking of similar or essentially identical building panels in an assembled position by means of a folding and/or vertical displacement, wherein an upper edge portion of a side edge of a first building panel and an upper edge portion of a side edge of a second building panel are, in the assembled position, juxtaposed to form a joint seal, said mechanical locking device comprising:

a locking surface at the upper edge portion of the side edge of the first building panel configured to cooperate with a locking surface at the upper edge portion of the side edge of the second building panel, wherein the two locking surfaces are configured to lock the side edge of the first building panel and the side edge of the second building panel in a direction parallel to the extension of the decorative surface, a locking strip, projecting outwardly from a lower edge portion of the side edge of the first building panel, comprising a locking element configured to be received in a locking groove of the side edge of the second building panel by means of said folding and/or vertical displacement, a locking surface on the locking element configured to cooperate with a locking surface in the locking groove, wherein the locking surface on the locking element and the locking surface in the locking groove are configured to prevent a displacement between the first and second building panels, an intermediate edge portion of the side edge of the second building panel comprising a surface configured to cooperate with a surface on the locking strip in the assembled position, wherein the locking strip is configured to be angularly displaced during the folding and/or vertical displacement, thereby undergoing an angular displacement, wherein the angular displacement together with the cooperation between the locking surface on the locking element and the locking surface in the locking groove are configured to create a pretension between the locking surface at the upper edge portion of the side edge of the first building panel and the locking surface at the upper edge portion of the side edge of the second building panel in the assembled position, and wherein a difference between an angle, relative to the extension of the decorative surface, of the surface on the locking strip and an angle, relative to the extension of the decorative surface, of the surface on the intermediate edge portion of the side edge of the second building panel decreases during the folding and/or vertical displacement, wherein the mechanical locking device further comprises a second tongue groove arranged in the intermediate edge portion of the side edge of the second building panel, configured to receive a second locking tongue protruding outwardly from an intermediate edge portion of the side edge of the first building panel, wherein a maximum height of the second locking tongue of the intermediate edge portion of the side edge of the first building panel is greater than a maximum height of the second tongue groove in the intermediate edge portion of the side edge of the second building panel, such that the mechanical locking device is configured to create a second pretension between the second locking tongue and the second tongue groove.

2. The set of building panels according to claim 1, wherein the pretension between the locking surface at the upper edge portion of the side edge of the first building panel and the locking surface at the upper edge portion of the side edge of the second building panel in the assembled position, is a horizontal pretension.

3. The set of building panels according to claim 1, wherein the surface on the locking strip of the first building panel and the surface on the intermediate edge portion of the side edge of the second building panel are planar.

4. The set of building panels according to claim 1, wherein the surface on the locking strip of the first building panel and the surface on the intermediate edge portion of the side edge of the second building panel are substantially parallel in the assembled position.

5. The set of building panels according to claim 1, wherein the surface on the locking strip of the first building panel and the surface on the intermediate edge portion of the side edge of the second building panel are substantially parallel to the extension of the decorative surface in the assembled position.

6. The set of building panels according to claim 1, wherein the mechanical locking device further comprises a first tongue groove, arranged in the intermediate edge portion of the side edge of the first building panel, configured to receive a first locking tongue, protruding outwardly from the intermediate edge portion of the side edge of the second building panel.

7. The set of building panels according to claim 6, wherein the mechanical locking device further comprises a locking surface at an upper wall of the first tongue groove configured to cooperate with an upper locking surface of the first locking tongue, wherein the two locking surfaces are configured to lock the side edge of the first building panel and the side edge of the second building panel in a direction perpendicular to the extension of the decorative surface in the assembled position.

8. The set of building panels according to claim 1, wherein the mechanical locking device further comprises a displaceable locking tongue, a displaceable tongue groove arranged in the intermediate edge portion of the side edge of the first building panel and configured to partly receive the displaceable locking tongue, and a displaceable tongue groove arranged in the intermediate edge portion of the side edge of the second building panel and configured to partly receive the displaceable locking tongue.

9. The set of building panels according to claim 1, wherein the mechanical locking device further comprises a locking surface at an upper wall of the second tongue groove configured to cooperate with an upper locking surface of the second locking tongue, wherein the two locking surfaces are configured to lock the side edge of the first building panel and the side edge of the second building panel in a direction perpendicular to the extension of the decorative surface in the assembled position.

10. The set of building panels according to claim 1, wherein the difference between the height of the second locking tongue and the height of the second tongue groove is in the range of 0.01 to 0.5 mm.

11. A set of building panels, wherein each building panel comprises a decorative surface and a mechanical locking device for horizontal and vertical locking of similar or essentially identical building panels in an assembled position by means of a folding and/or vertical displacement, wherein an upper edge portion of a side edge of a first building panel and an upper edge portion of a side edge of a second building panel are, in the assembled position, juxtaposed to form a joint seal, said mechanical locking device comprising:

a locking surface at the upper edge portion of the side edge of the first building panel configured to cooperate with a locking surface at the upper edge portion of the side edge of the second building panel, wherein the two locking surfaces are configured to lock the side edge of the first building panel and the side edge of the second building panel in a direction parallel to the extension of the decorative surface, a locking strip, projecting outwardly from a lower edge portion of the side edge of the first building panel, comprising a locking element configured to be received in a locking groove of the side edge of the second building panel by means of said folding and/or vertical displacement, a locking surface on the locking element configured to cooperate with a locking surface in the locking groove, wherein the locking surface on the locking element and the locking surface in the locking groove are configured to prevent a displacement between the first and second building panels, an intermediate edge portion of the side edge of the second building panel comprising a surface configured to cooperate with a surface on the locking strip in the assembled position, wherein the locking strip is configured to be angularly displaced during the folding and/or vertical displacement, thereby undergoing an angular displacement, wherein the angular displacement together with the cooperation between the locking surface on the locking element and the locking surface in the locking groove are configured to create a pretension between the locking surface at the upper edge portion of the side edge of the first building panel and the locking surface at the upper edge portion of the side edge of the second building panel in the assembled position, and wherein a difference between an angle, relative to the extension of the decorative surface, of the surface on the locking strip and an angle, relative to the extension of the decorative surface, of the surface on the intermediate edge portion of the side edge of the second building panel decreases during the folding and/or vertical displacement, wherein the pretension between the locking surface at the upper edge portion of a first side edge of a first building panel and the opposite locking surface at the upper edge portion of the third side edge of a second building panel, in the assembled position, is greater than the pretension between the locking surface at the upper edge portion of a second side edge of the first building panel and the opposite locking surface at the upper edge portion of the fourth side edge of a third building panel, in the assembled position.

12. A set of building panels, wherein each building panel comprises a decorative surface and a mechanical locking device for horizontal and vertical locking of similar or essentially identical building panels in an assembled position by means of a folding and/or vertical displacement, wherein an upper edge portion of a side edge of a first building panel and an upper edge portion of a side edge of a second building panel are, in the assembled position, juxtaposed to form a joint seal, said mechanical locking device comprising:

a locking strip, projecting outwardly from a lower edge portion of the side edge of the first building panel, comprising a locking element configured to be received in a locking groove arranged in a lower edge portion of the side edge of the second building panel by means of said folding and/or vertical displacement, a locking surface at the upper edge portion of the side edge of the first building panel configured to cooperate with a locking surface at the upper edge portion of the side edge of the second building panel, wherein the two locking surfaces are configured to lock the side edge of the first building panel and the side edge of the second building panel in a direction parallel to the extension of the decorative surface, a locking surface on the locking element configured to cooperate with a locking surface in the locking groove, wherein the locking surface on the locking element and the locking surface in the locking groove are configured to prevent a displacement between the first and second building panels, wherein a first dimension, measured between a point on the locking surface at the upper edge portion of the side edge of the first building panel and a point on the locking surface on the locking element, in an unassembled position, is smaller than a second dimension, measured between the point on the locking surface at the upper edge portion of the side edge of the first building panel and the point on the locking surface of the locking element, in the assembled position.

13. The set of building panels according to claim 12, wherein a third dimension, measured between a point on the locking surface at the upper edge portion of the side edge of the second building panel and a point on the locking surface in the locking groove, is greater than the first dimension.

14. The set of building panels according to claim 12, wherein the mechanical locking device further comprises a first tongue groove, arranged in an intermediate edge portion of the side edge of the first building panel, configured to receive a first locking tongue, protruding outwardly from an intermediate edge portion of the side edge of the second building panel.

15. The set of building panels according to claim 14, wherein the mechanical locking device further comprises a locking surface at an upper wall of the first tongue groove configured to cooperate with an upper locking surface of the first locking tongue, wherein the two locking surfaces are configured to lock the side edge of the first building panel and the side edge of the second building panel in a direction perpendicular to the extension of the decorative surface in the assembled position.

16. The set of building panels according to claim 12, wherein the mechanical locking device further comprises a displaceable locking tongue, a displaceable tongue groove arranged in an intermediate edge portion of the side edge of the first building panel and configured to partly receive the displaceable locking tongue, and a displaceable tongue groove arranged in an intermediate edge portion of the side edge of the second building panel and configured to partly receive the displaceable locking tongue.

17. The set of building panels according to claim 12, wherein the mechanical locking device further comprises a second tongue groove, arranged in an intermediate edge portion of the side edge of the second building panel, configured to receive a second locking tongue, protruding outwardly from an intermediate edge portion of the side edge of the first building panel.

18. The set of building panels according to claim 17, wherein the mechanical locking device further comprises a locking surface at an upper wall of the second tongue groove configured to cooperate with an upper locking surface of the second locking tongue, wherein the two locking surfaces are configured to lock the side edge of the first building panel and the side edge of the second building panel in a direction perpendicular to the extension of the decorative surface in the assembled position.

19. The set of building panels according to claim 18, wherein the angular displacement of the locking strip together with the cooperation between the locking surface on the locking element and the locking surface in the locking groove are configured to create a vertical pretension between the locking surface at the upper wall of the tongue groove and the locking surface of the locking tongue in the assembled position.

20. The set according to claim 17, wherein the height of the second locking tongue of the intermediate edge portion of the side edge of the first building panel is greater than the height of the second tongue groove in the intermediate edge portion of the side edge of the second building panel.

21. The set according to claim 20, wherein the difference between the height of the second locking tongue and the height of the second tongue groove is in the range of 0.01 to 0.5 mm.

22. The set according to claim 12, wherein a pretension between the locking surface at the upper edge portion of a first side edge of a first building panel and the opposite locking surface at the upper edge portion of the third side edge of a second building panel, in the assembled position, is greater than a pretension between the locking surface at the upper edge portion of a second side edge of the first building panel and the opposite locking surface at the upper edge portion of the fourth side edge of a third building panel, in the assembled position.

* * * * *